US010305182B1

(12) United States Patent
Iellici

(10) Patent No.: US 10,305,182 B1
(45) Date of Patent: May 28, 2019

(54) BALANCED ANTENNA

(71) Applicant: Airgain Incorporated, San Diego, CA (US)

(72) Inventor: Devis Iellici, Cambridge (GB)

(73) Assignee: Airgain Incorporated, San Diego, CA (US)

( * ) Notice: Subject to any disclaimer, the term of this patent is extended or adjusted under 35 U.S.C. 154(b) by 1 day.

(21) Appl. No.: 15/859,628

(22) Filed: Dec. 31, 2017

Related U.S. Application Data

(60) Provisional application No. 62/459,068, filed on Feb. 15, 2017.

(51) Int. Cl.

| | |
|---|---|
| ***H01Q 5/15*** | (2015.01) |
| ***H01Q 1/48*** | (2006.01) |
| ***H01Q 7/06*** | (2006.01) |
| ***H01Q 1/52*** | (2006.01) |
| ***H01Q 1/38*** | (2006.01) |

(52) U.S. Cl.
CPC ..... *H01Q 5/15* (2015.01); *H01Q 1/38* (2013.01); *H01Q 1/48* (2013.01); *H01Q 1/52* (2013.01); *H01Q 7/06* (2013.01)

(58) Field of Classification Search
CPC .. H01Q 5/15; H01Q 1/38; H01Q 1/48; H01Q 1/52; H01Q 7/06
USPC ..... 343/702
See application file for complete search history.

(56) References Cited

U.S. PATENT DOCUMENTS

| | | | |
|---|---|---|---|
| 7,061,437 | B2 | 6/2006 | Lin et al. |
| 7,148,849 | B2 | 12/2006 | Lin |
| 7,215,296 | B2 | 5/2007 | Abramov et al. |
| D546,821 | S | 7/2007 | Oliver |
| D549,696 | S | 8/2007 | Oshima et al. |
| 7,333,067 | B2 | 2/2008 | Hung et al. |
| 7,336,959 | B2 | 2/2008 | Khitrik et al. |
| D573,589 | S | 7/2008 | Montgomery et al. |
| 7,405,704 | B1 | 8/2008 | Lin et al. |
| 7,477,195 | B2 | 1/2009 | Vance |
| D592,195 | S | 5/2009 | Wu et al. |
| 7,570,215 | B2 | 8/2009 | Abramov et al. |
| D599,334 | S | 9/2009 | Chiang |
| D606,053 | S | 12/2009 | Wu et al. |
| D607,442 | S | 1/2010 | Su et al. |
| D608,769 | S | 1/2010 | Bufe |
| D612,368 | S | 3/2010 | Yang et al. |
| 7,705,783 | B2 | 4/2010 | Rao et al. |
| 7,729,662 | B2 | 6/2010 | Abramov et al. |
| D621,819 | S | 8/2010 | Tsai et al. |
| 7,843,390 | B2 | 11/2010 | Liu |
| D633,483 | S | 3/2011 | Su et al. |
| D635,127 | S | 3/2011 | Tsai et al. |
| 7,907,971 | B2 | 3/2011 | Salo et al. |
| D635,560 | S | 4/2011 | Tsai et al. |

(Continued)

*Primary Examiner* — Andrea Lindgren Baltzell
(74) *Attorney, Agent, or Firm* — Clause Eight IPS; Michael Catania

(57) ABSTRACT

A balance antenna is disclosed herein. The balanced antenna comprises a first planar conductor layer forming an first infinite balun, a second planar conductor layer forming a second infinite balun, and a feeding gap. A cable transports a radio signal from the antenna to a radio and from a radio to the antenna. The first infinite balun and the second infinite balun transform an unbalanced transmission line characteristic of the cable to the balanced feeding of the antenna.

20 Claims, 49 Drawing Sheets

(56) References Cited

U.S. PATENT DOCUMENTS

| | | | |
|---|---|---|---|
| D635,963 | S | 4/2011 | Podduturi |
| D635,964 | S | 4/2011 | Podduturi |
| D635,965 | S | 4/2011 | Mi et al. |
| D636,382 | S | 4/2011 | Podduturi |
| 7,965,242 | B2 | 6/2011 | Abramov et al. |
| D649,962 | S | 12/2011 | Tseng et al. |
| D651,198 | S | 12/2011 | Mi et al. |
| D654,059 | S | 2/2012 | Mi et al. |
| D654,060 | S | 2/2012 | Ko et al. |
| D658,639 | S | 5/2012 | Huang et al. |
| D659,129 | S | 5/2012 | Mi et al. |
| D659,685 | S | 5/2012 | Huang et al. |
| D659,688 | S | 5/2012 | Huang et al. |
| 8,175,036 | B2 | 5/2012 | Visuri et al. |
| 8,184,601 | B2 | 5/2012 | Abramov et al. |
| D662,916 | S | 7/2012 | Huang et al. |
| 8,248,970 | B2 | 8/2012 | Abramov et al. |
| D671,097 | S | 11/2012 | Mi et al. |
| 8,310,402 | B2 | 11/2012 | Yang |
| D676,429 | S | 2/2013 | Gosalia et al. |
| D678,255 | S | 3/2013 | Ko et al. |
| 8,423,084 | B2 | 4/2013 | Abramov et al. |
| D684,565 | S | 6/2013 | Wei |
| D685,352 | S | 7/2013 | Wei |
| D685,772 | S | 7/2013 | Zheng et al. |
| D686,600 | S | 7/2013 | Yang |
| D689,474 | S | 9/2013 | Yang et al. |
| D692,870 | S | 11/2013 | He |
| D694,738 | S | 12/2013 | Yang |
| D695,279 | S | 12/2013 | Yang et al. |
| D695,280 | S | 12/2013 | Yang et al. |
| 8,654,030 | B1 | 2/2014 | Mercer |
| D703,195 | S | 4/2014 | Zheng |
| D703,196 | S | 4/2014 | Zheng |
| D706,247 | S | 6/2014 | Zheng et al. |
| D706,750 | S | 6/2014 | Bringuir |
| D706,751 | S | 6/2014 | Chang et al. |
| D708,602 | S | 7/2014 | Gosalia et al. |
| D709,053 | S | 7/2014 | Chang et al. |
| D710,832 | S | 8/2014 | Yang |
| D710,833 | S | 8/2014 | Zheng et al. |
| 8,854,265 | B1 | 10/2014 | Yang et al. |
| D716,775 | S | 11/2014 | Bidermann |
| 9,432,070 | B2 | 8/2016 | Mercer |
| 2002/0003499 | A1 | 1/2002 | Kouam et al. |
| 2004/0222936 | A1 | 11/2004 | Hung et al. |
| 2005/0073462 | A1 | 4/2005 | Lin et al. |
| 2005/0190108 | A1 | 9/2005 | Lin et al. |
| 2006/0208900 | A1 | 9/2006 | Tavassoli Hozouri |
| 2007/0030203 | A1 | 2/2007 | Tsai et al. |
| 2008/0150829 | A1 | 6/2008 | Lin et al. |
| 2009/0002244 | A1 | 1/2009 | Woo |
| 2009/0058739 | A1 | 3/2009 | Konishi |
| 2009/0135072 | A1 | 5/2009 | Ke et al. |
| 2009/0262028 | A1 | 10/2009 | Murnbru et al. |
| 2010/0188297 | A1 | 7/2010 | Chen et al. |
| 2010/0309067 | A1* | 12/2010 | Tsou ..... H01Q 3/26 343/726 |
| 2011/0006950 | A1 | 1/2011 | Park et al. |
| 2012/0038514 | A1 | 2/2012 | Bang |
| 2012/0229348 | A1 | 9/2012 | Chiang |
| 2012/0242546 | A1* | 9/2012 | Hu ..... H01Q 1/243 343/700 MS |

* cited by examiner

Worst case coupling across 10 positions

BALANCED ANTENNA

CROSS REFERENCE TO RELATED APPLICATION

The Present Application claims priority to U.S. Provisional Patent Application No. 62/459,068, filed on Feb. 15, 2017, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention generally relates to antennas, and more particularly an electrically small antenna which is balanced and has a much reduced effect from the coaxial cable used to connect the antenna to the corresponding radio transceiver.

Description of the Related Art

In the recent technological evolution, wireless connectivity has become ubiquitous, with all kind of devices being capable of transferring data or voice wirelessly to other devices. Such wireless connectivity uses a variety of radio system working on various radio-frequency bands, typically in the range 50 MHz to 60 GHz.

Each radio is connected to one or multiple antennas, which allow the transferring of the radiofrequency signal from the air channel to the transmission line connected to the radio front-end and vice-versa. Therefore, said technological evolution has been accompanied by the proliferation of antennas which are connected to or embedded in electronic devices.

Although in some cases the antennas are structures connected directly to printed circuit board (PCB) accommodating the radio transceiver, and in some cases the antenna is created directly as a conductive shape printed on said PCB, in many other cases it is convenient to place the antennas away from the PCB, and use a coaxial cable or an equivalent transmission line to connect the antenna to the radio transceiver. The advantages of such arrangement can be manifold, for instance: 1) Placing the antenna in a more convenient position for interfacing with the over-the-air propagation channel; 2) Reducing the amount of noise or interferers picked-up by the antenna from the PCB containing the radio or other components of the device using the antenna; 3) Increase the isolation between multiple antennas, facilitating the coexistence between different radios; 4) Reduce the correlation between the radiation patterns of multiple antennas, which is advantageous in the case of diversity or MIMO (Multiple In Multiple Out) wireless systems; and 5) Reduce the effect that the PCB with the radio or other components of the device using the antenna have on the radiation pattern, the impedance matching, the antenna efficiency, peak gain and other quality factors of the antenna.

The presence of a coaxial cable can also bring significant drawbacks, particularly if the antenna is electrically small, i.e. its dimensions are comparable or smaller than half of the wavelength at the operating frequency. In particular, if the antennas is designed in such a way that the electromagnetic currents can flow from between the antenna conductors and the outer surface of the conducting shielding structure of the cable, such stray currents can significantly affect the behaviour of the antenna itself. Effectively, the cable becomes part of the radiating structure forming the antenna, and therefore the antenna behaviour becomes dependent on the physical details of the cable, such as its length, how it is routed and how it is terminated.

This causes several problems in the design and integration of the antenna into devices: 1) Impedance matching depends on the cable routing and on where it is connected to the PCB; 2) Antenna gain pattern, and in particular peak gain, is also affected by the details of the cable routing. This can be a serious problem when the radiation pattern is required to have an exact shape or when the device has to meet specific electromagnetic compliance requirements based on peak gain or e.i.r.p. (equivalent isotropically radiated power); 3) Isolation between multiple antennas is reduced by the coupling between the respective cables; 4) Noise rejection of the antenna is degraded, as noise is picked up by the cable and transferred to the radio receiver through the antenna itself; and 5) Unstable performance if the position of the cable changes or it is not tightly controlled in the manufacturing process.

All this justifies the need for a novel, very compact antenna structure designed in such a way the coaxial cable or transmission line used to connected it to the radio has a greatly reduced effect on the performance of the antenna itself.

A large proportion of cable-fed electrically small antennas is based on some variation of the basic half-wavelength dipole design. The harmful effect of connecting the cable to a dipole is well known and discussed in most antenna textbooks. The classical solution to the problem is adding a ¼-wavelength sleeve choke or balun on the cable close to the point where the cable is connected to the dipole. For instance, the operation of sleeve baluns is discussed in Balanis, C. A., "Antenna Theory: Analysis and Design", 2005 (3rd ed.), Wiley and Sons. P., and Huang, Y., and Boyle, K., "Antennas—From theory to practice", Wiley, 2008, and illustrated in FIG. 1.

Sleeve baluns are effective over a narrow frequency bandwidth, being ¼-wavelength devices, and ferrite beads are not effective at high frequency, let's say above a few hundred MHz. Moreover, sleeve baluns are mechanically large and too expensive to be used in high volume manufacturing. Planar designs of the ¼-wavelength balun, suitable to be realized using PCB technology, are available; however, they are not very effective and physically large, having a size typically comparable to half of the actual antenna size. FIG. 1 illustrates a planar design on a two-sided PCB.

The planar dipole with integrated balun was disclosed in Alford, U.S. Pat. No. 3,114,913 for a Wing Type Diploe Antenna With U-Shaped Director, and a printed version in Edward et al., U.S. Pat. No. 4,825,220 for a Microstrip Fed Printed Dipole With An Integral Balun. The printed dipole with integrated balun is widely used in the industry in various forms and variants. For instance, it is commonly used in a crossed-dipole configuration to generate circular polarization. In Pickles, U.S. Patent Publication Number 20100271280 for a Double Balun Dipole, a variant of the printed dipole with two Marchand baluns in introduced.

The sleeve or printed balun can be replaced with a lumped balun, for instance a multilayer ceramic element, o realized using L-C components. Although this solution can considerably reduce the size of the solution, has the drawbacks of increasing cost and adding unwanted loss through the balun element.

Another, less common, type of balun that can be used to feed a loop-type antenna is the infinite balun, illustrated in FIG. 5 as realized by bending the coaxial cable itself.

Infinite baluns and relative applications to loop-type and dipole-type antenna are disclosed in Onnigian et al., U.S. Pat. No. 5,068,672, for a Balanced Antenna Feed System.

Because of the symmetry, at the soldering point $\vec{J}_1=\vec{J}_2$ and therefore, for current conservation, $\vec{J}_3=0$, and there is no RF current flowing on the outside of the cable. Because the current cancellation depends on the symmetry of the structure and not on some dimensions being close to ¼-wavelength, the infinite balun works at any frequency, or at least up to where the size of the gap and the small asymmetry can be ignored.

It is possible to create a printed version of the loop antenna with the infinite balun, by replacing part of the cable by mean of a printed transmission line, e.g. microstrip line. This is illustrated in FIG. 6.

Although the loop antenna with the infinite balun achieves an excellent degree of cancellation of the currents on the feeding cable, it also has some practical disadvantages due to the relative large size, as the loop perimeter has to be close to a full wavelength, the poor impedance bandwidth of the antenna and, in the case of the printed version, the loss in the printed transmission line, around ½-wavelength. Moreover, because one side of the loop has to support the transmission line, the conductor cannot be easily made thin and meandered to increase the effective electrical length and reduce the overall antenna size.

If an antenna is not self-balanced and the shielding of the coaxial cable connected to the antenna acts as a (partial) radio frequency (RF) counterpoise, and therefore there are RF currents propagating along the cable. Such stray RF currents can alter the impedance seen at the terminals of the antenna, as well as its radiation pattern and other antenna characteristics. These effect make the performance of the antenna dependent on the cable length and routing, which is undesirable. Moreover, noise generated on the device to which the antenna is connected and propagating along the coaxial cable can easily pass through the antenna and reach the radio receiver, causing various issues like blocking and desensitization.

BRIEF SUMMARY OF THE INVENTION

One embodiment is a balanced antenna system having a coaxial cable, planar conductors with specific shapes arranged in one, two or more parallel layers, a conducting element between the layers, infinite baluns, and non-conductive support. The coaxial cable transports the radio signal from the antenna to the radio (receiving mode) and from the radio to the antenna (transmitting mode). The planar conductors are the antenna. The conducting element provides electrical connection between the conducting layers. The infinite baluns transform the unbalanced transmission line characteristic of the coaxial cable to the balanced feeding of the antenna; at the same time, the return currents cancel each-other at position where the external shielding of the coaxial cable is connected to the antenna, preventing the currents from running along the cable itself. The non-conductive support provides mechanical support for the conducting elements.

The conductor forming the antenna is designed as a planar structure which, from the electromagnetic point of view is almost perfectly symmetric with respect to the axis defined by the coaxial cable connected to the antenna; moreover, the antenna conductor is designed to form two overlapping "infinite balun" structures in such a way that all RF currents cancel each-other in the point where the outer shielding of the coaxial cable is electrically connected to the antenna conductor; furthermore, the electric field generated by the antenna is orthogonal to the cable, and therefore no RF currents are excited on the cable itself.

The object of the present invention is an improvement of the printed loop with an infinite balun design.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
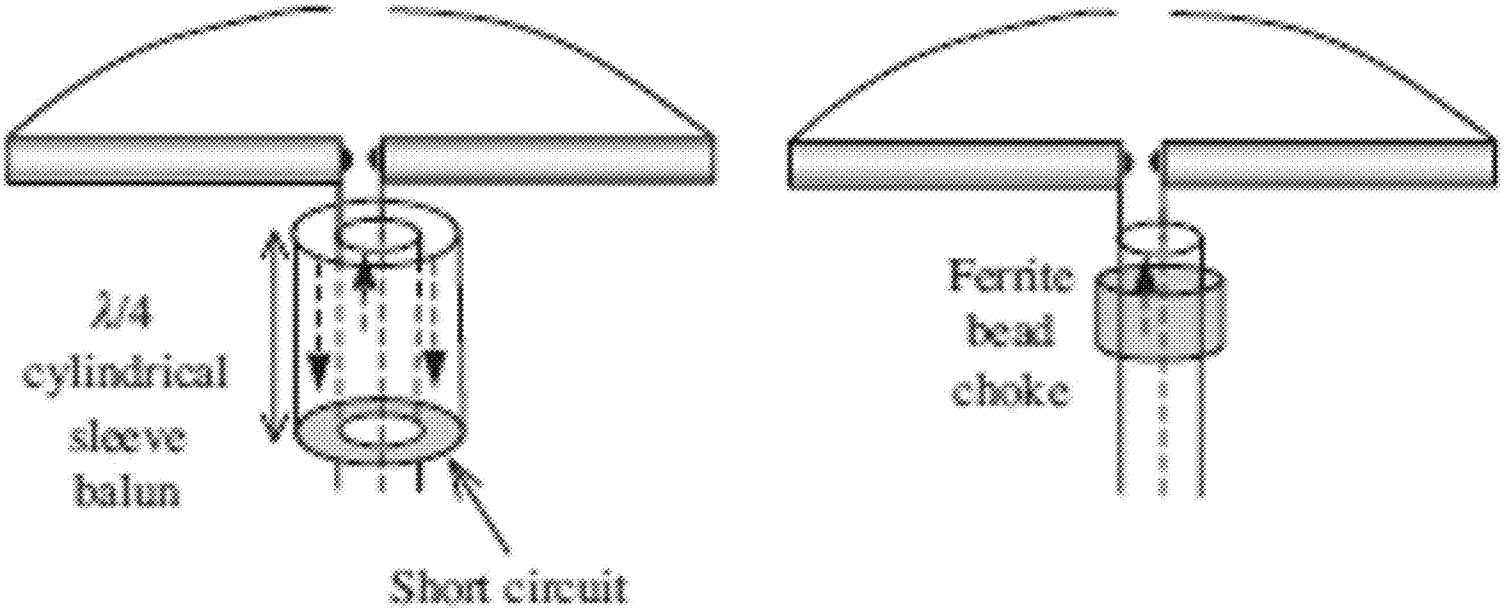
FIG. 1 is an illustration of a sleeve and ferrite baluns or chokes of the prior art.
Figure 2:
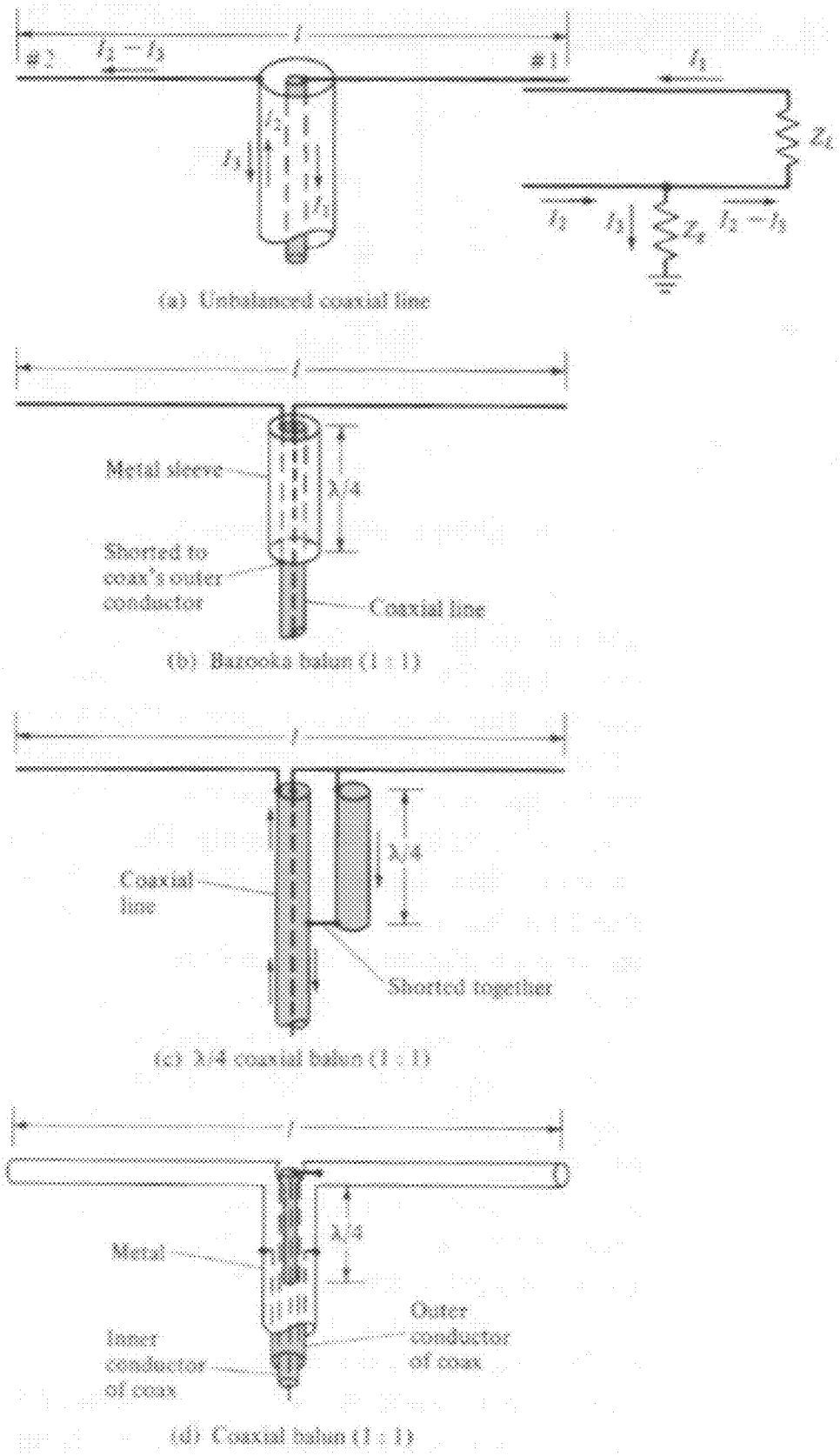
FIG. 2 is an illustration of prior art quarter wavelength baluns used with dipoles from FIG. 1.
Figure 3:
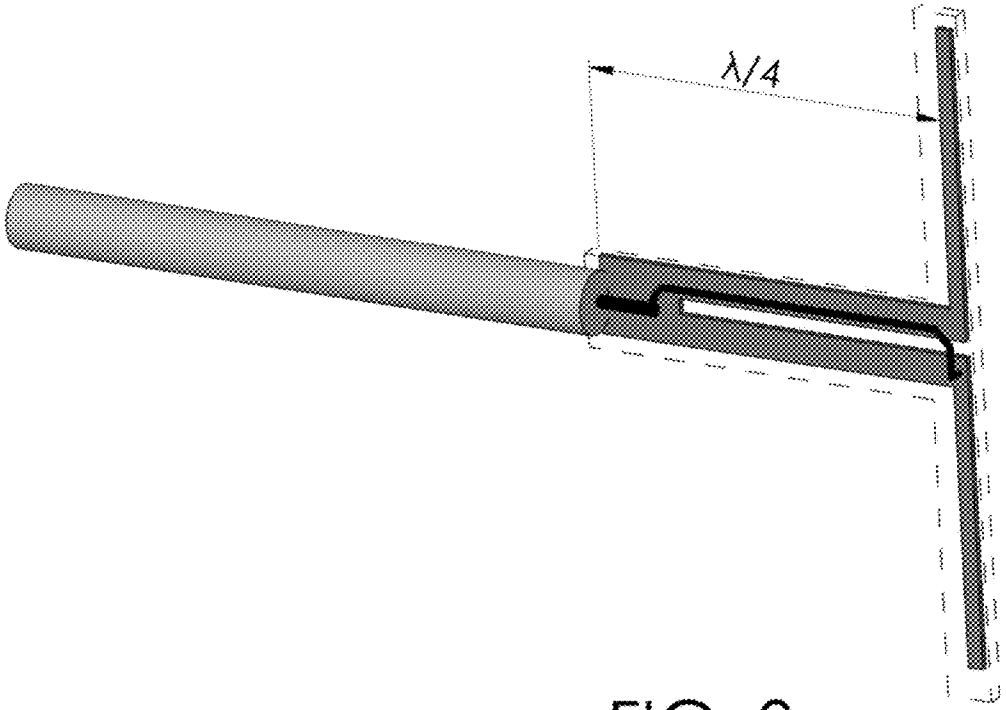
FIG. 3 is an illustration of a printed dipole with an integrated quarter wavelength balun of the prior art.
Figures 1B, 4:
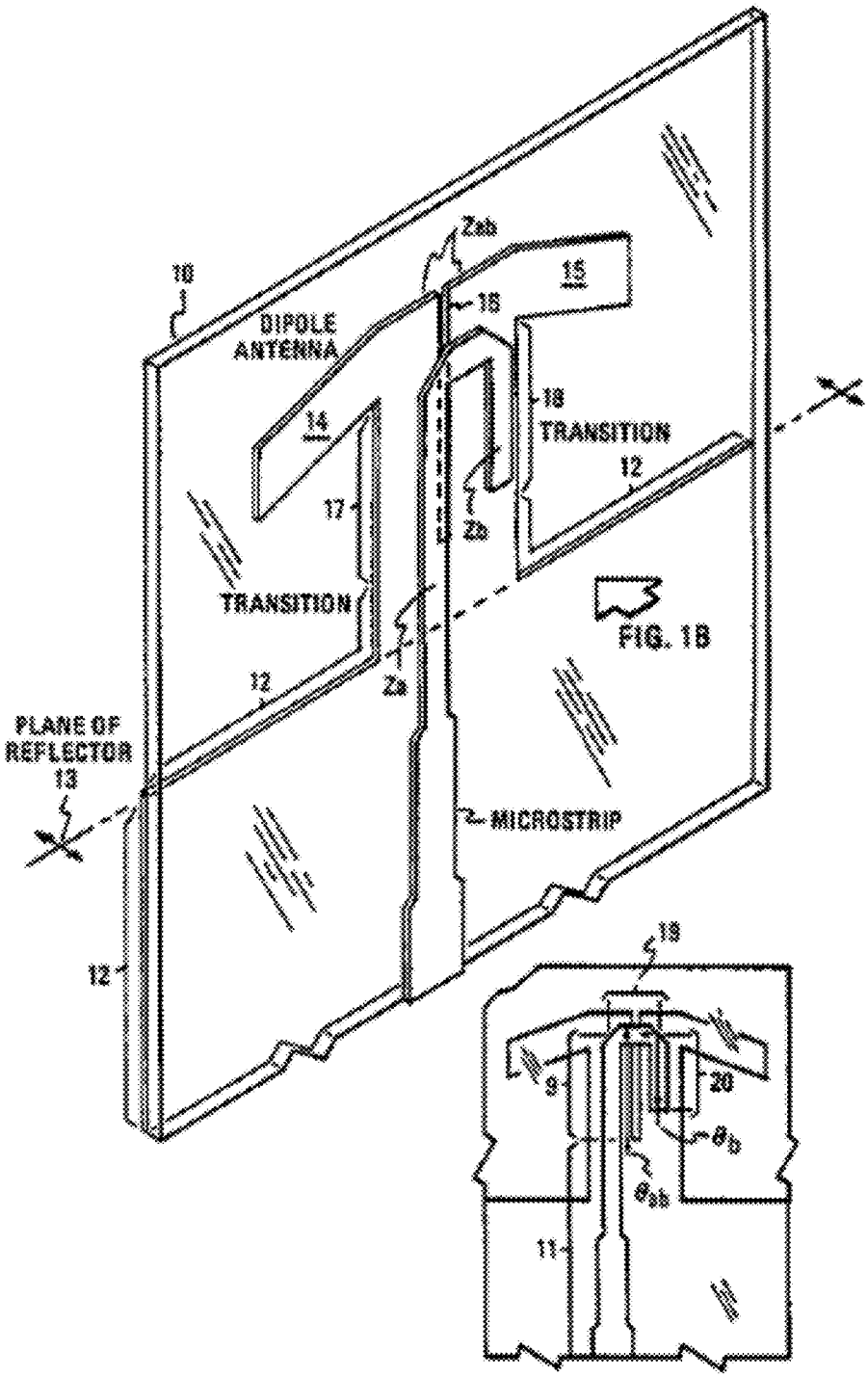
FIG. 4 is an illustration of a microstrip fed printed dipole with an integral balun of the prior art.
Figure 5:
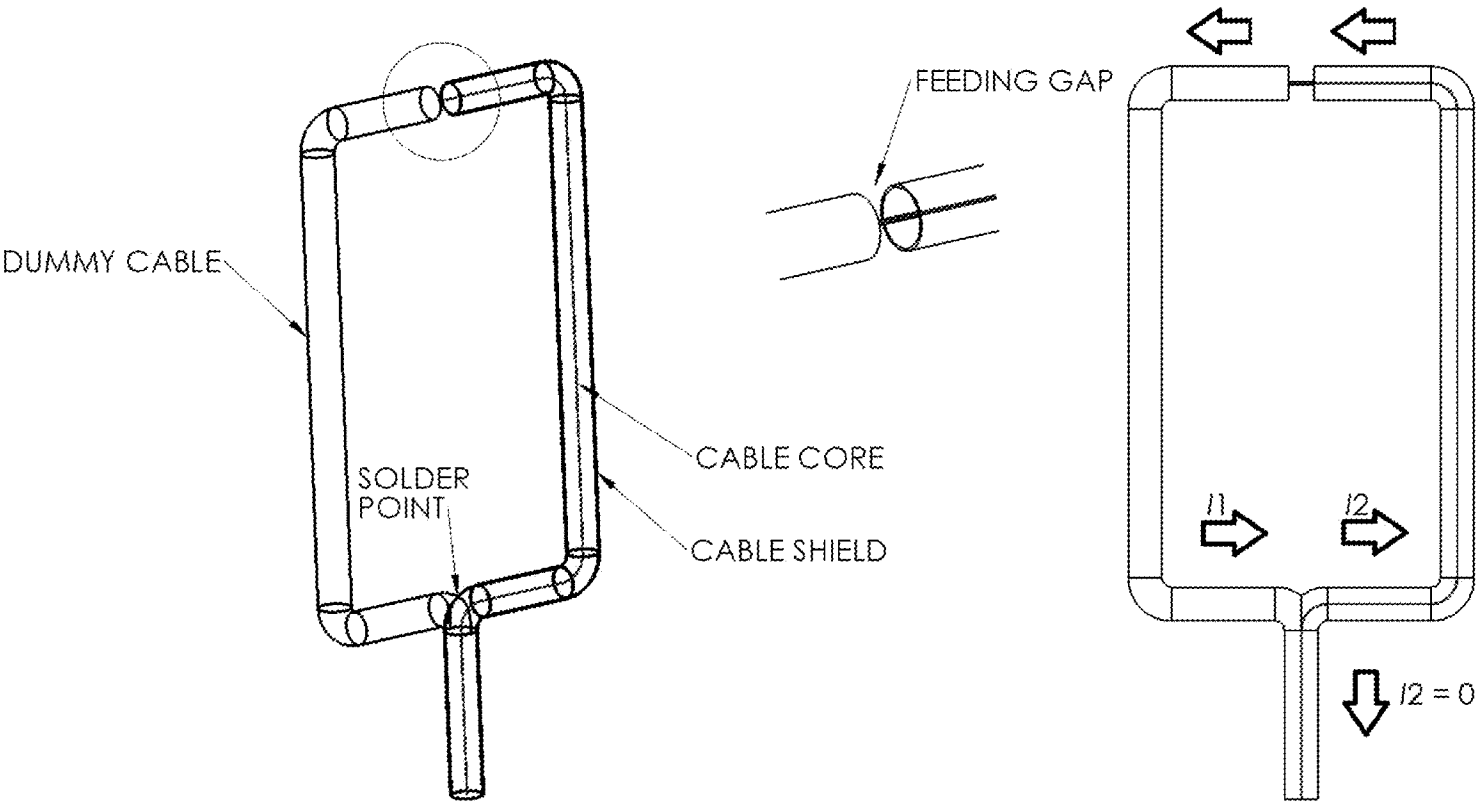
FIG. 5 is an illustration of a lop antenna with an integral infinite balun of the prior art.
Figure 6:
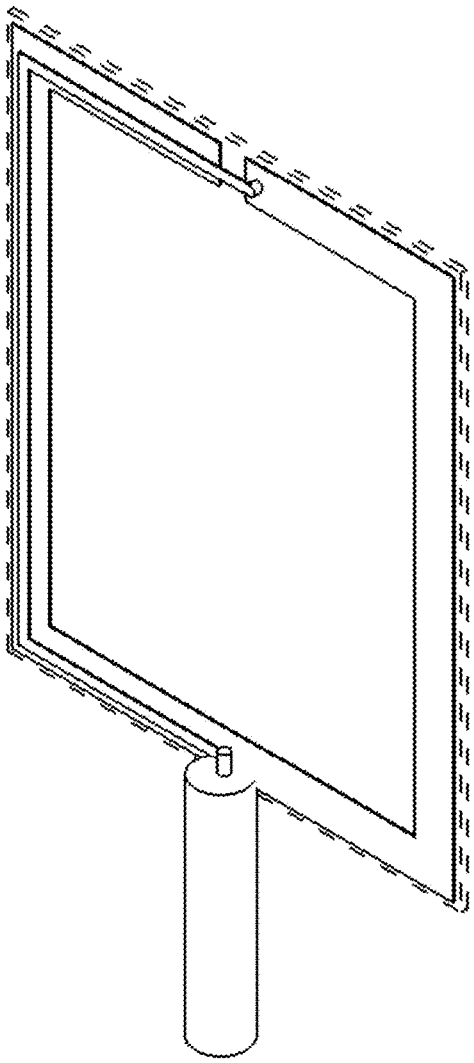
FIG. 6 is an illustration of a printed loop with an infinite balun of the prior art.
Figure 7:
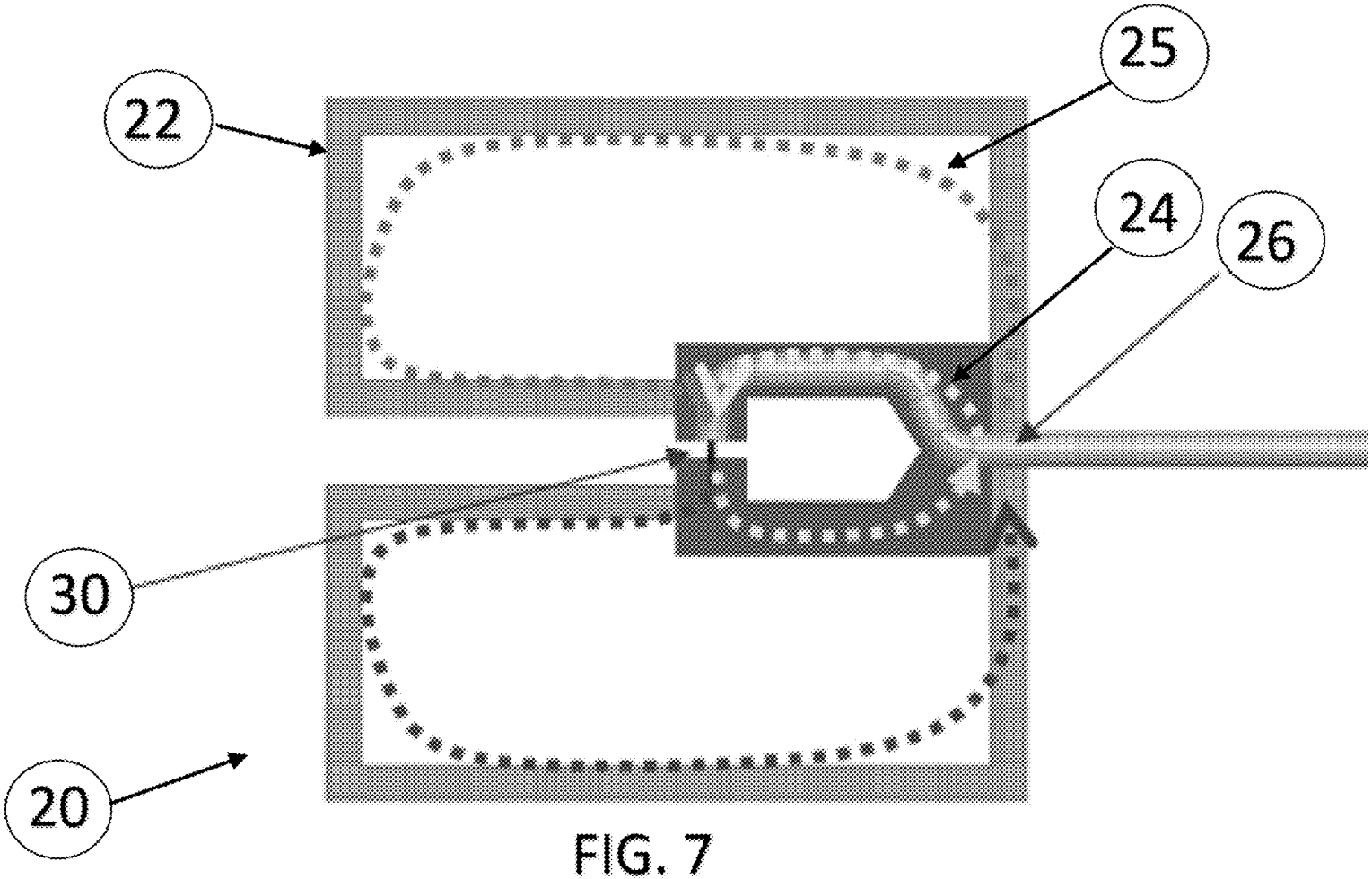
FIG. 7 is an illustration of a loop with a double infinite balun.

As shown in FIG. 7, the object of the present invention is an improvement of the printed loop with an infinite balun design. Starting from the infinite balun loop antenna, the basic aspects of the invention can be summarized as: 1) To avoid running the coaxial cable or the transmission line along the perimeter of the loop, the cable is routed directly towards the feeding gap or the loop arms are modified moving the feeding gap towards the cable, or a combination of both; 2) The cable is offset from the symmetry axis of the antenna and bent in a way convenient to feed the antenna across the gap; 3) A second conducting element is created which mirrors the path followed by the cable to maintain the electrical symmetry of the structure; and 4) The cable exit from the antenna structure is along the symmetry axis.

In this arrangement, as shown in FIG. 7, the conductors can be understood as forming two infinite baluns, one small infinite balun 24 and one large infinite balun 22. Because of the intrinsic symmetry of the structure and using the superposition principle and the current conservation at the point a where the cable 26 is first electrically connected to the antenna 20, one can see that the electromagnetic currents 23 and 25 excited at the gap 30 of the antenna cannot flow along the outer shielding of the coaxial cable.

The proposed antenna structure 20 is conveniently realized on a Printed Circuit Board (PCB), but it is also realized using other techniques like Flexible Printed Circuit (FPC), stamped metal, Laser Direct Structuring (LDS) and others.

Figure 8:
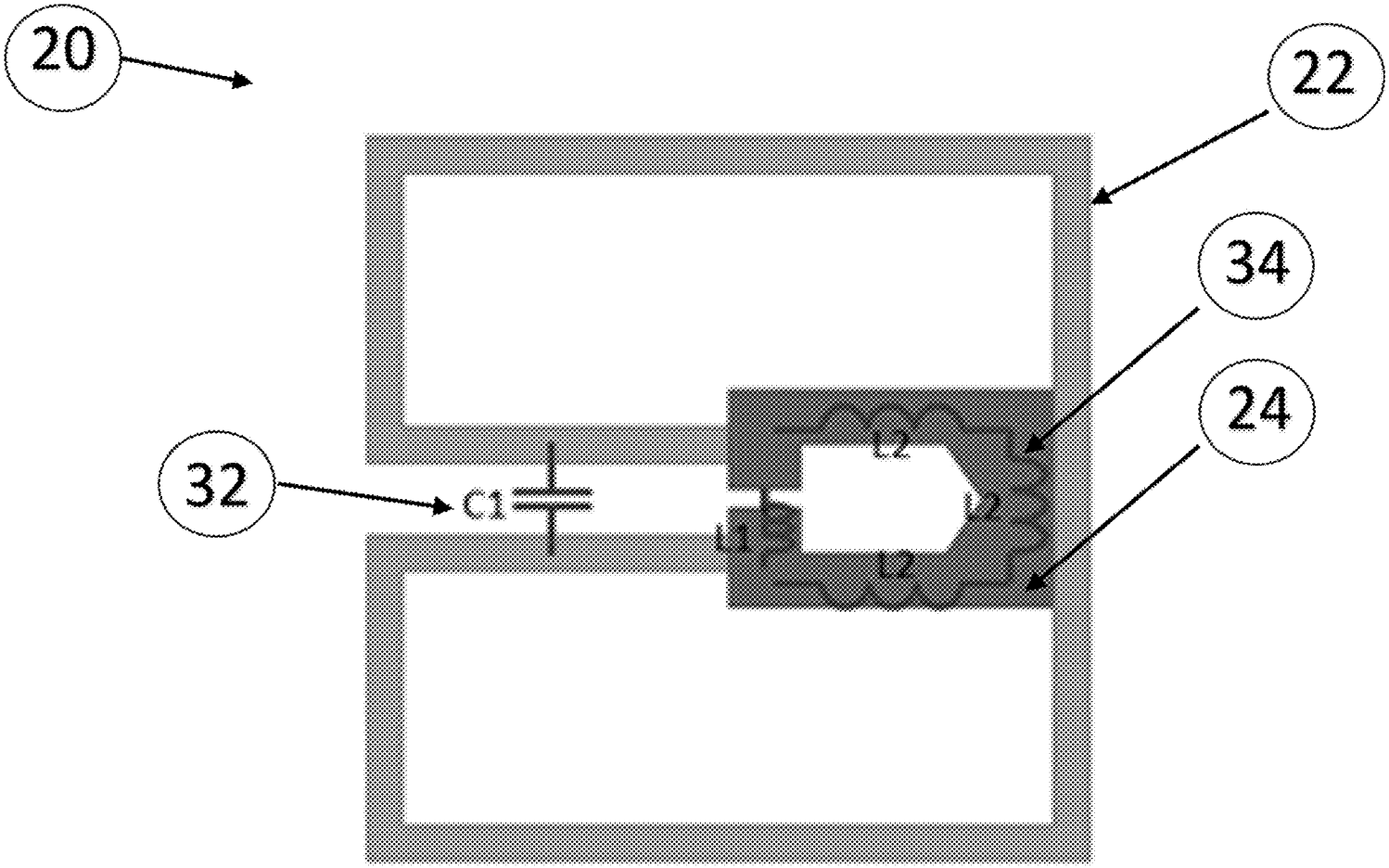
FIG. 8 is an illustration of a loop with a double infinite balun.
Figure 8A:
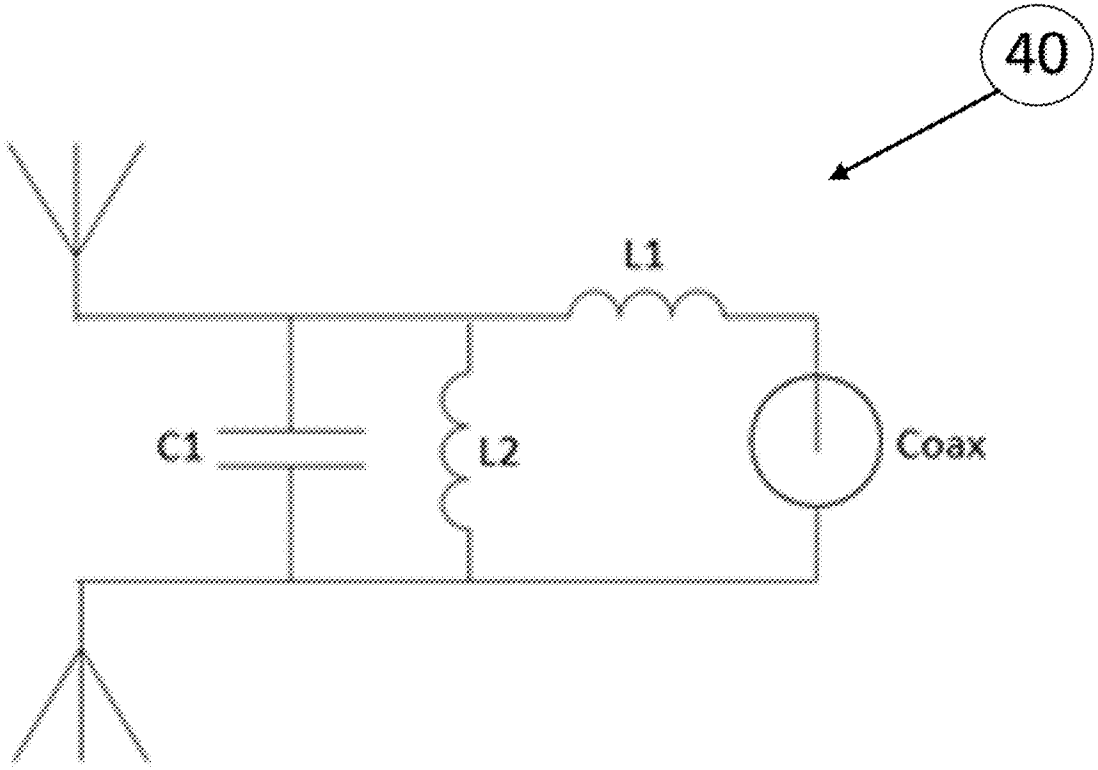
FIG. 8A is a schematic representation of impedance matching elements.

The antenna design using the double infinite balun has the further advantage of incorporating a (printed) matching circuit that is used to adjust the impedance matching of the antenna 20. The schematic representation of the matching circuit 40 having capacitor 32 and resistors 34 (L1) is given in FIGS. 8 and 8A. L1 introduces an asymmetry in the structure, so it is typically desirable to keep it small.

The property of the proposed design of having a much reduced level of radiofrequency currents on the cable is demonstrated by simulating the surface currents density using an electromagnetic simulator.

Figure 9:
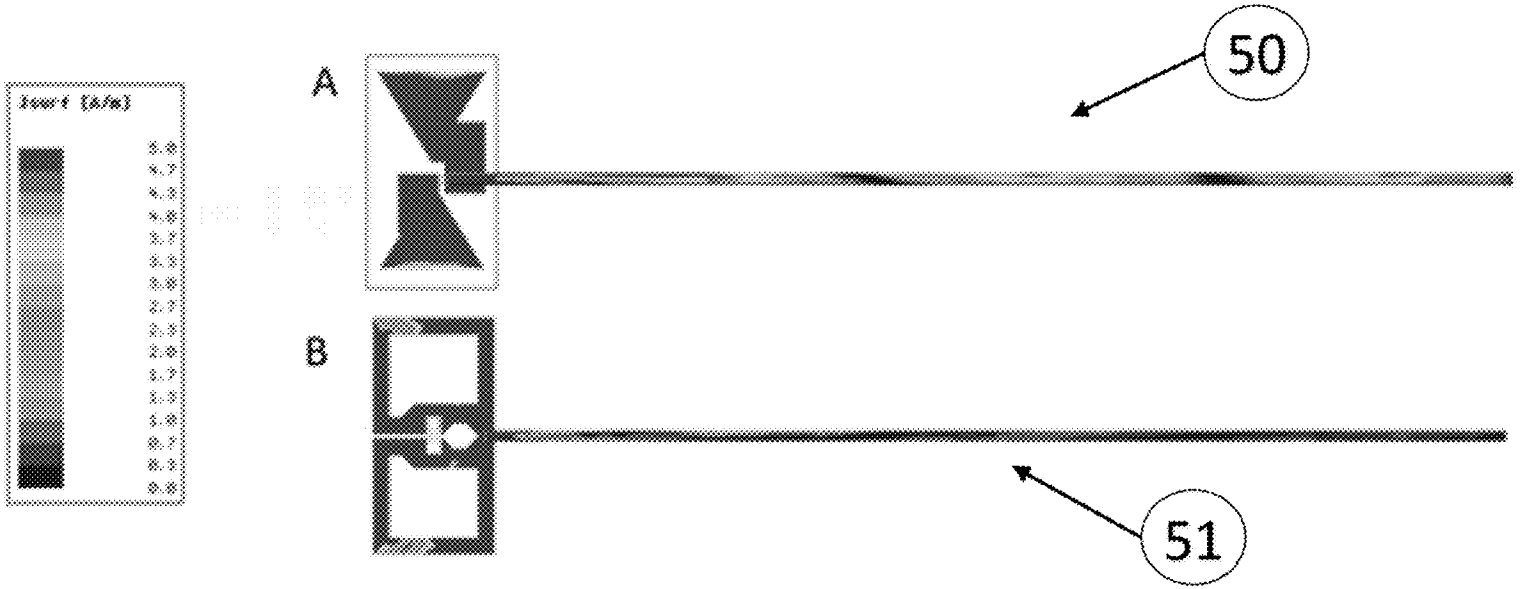
FIG. 9 is an illustration of surface current density of an un-balanced fed dipole type antenna (A) and a balanced antenna (B).

FIG. 9 compares the surface current density 50 and 51 for an unbalanced fed dipole (A) and an antenna (B) designed according to the present invention. In both cases the antenna area is 19.0×11.0 mm, the cable length is 80 mm and the operating frequency is 5500 MHz. It is apparent that the current density 51 on the cable is reduced by at least a factor 5 using the present invention. As the radiation is proportional to the square of the current density, one can expect the radiation from the cable to be reduced by 14 dB or more.

Figure 10:
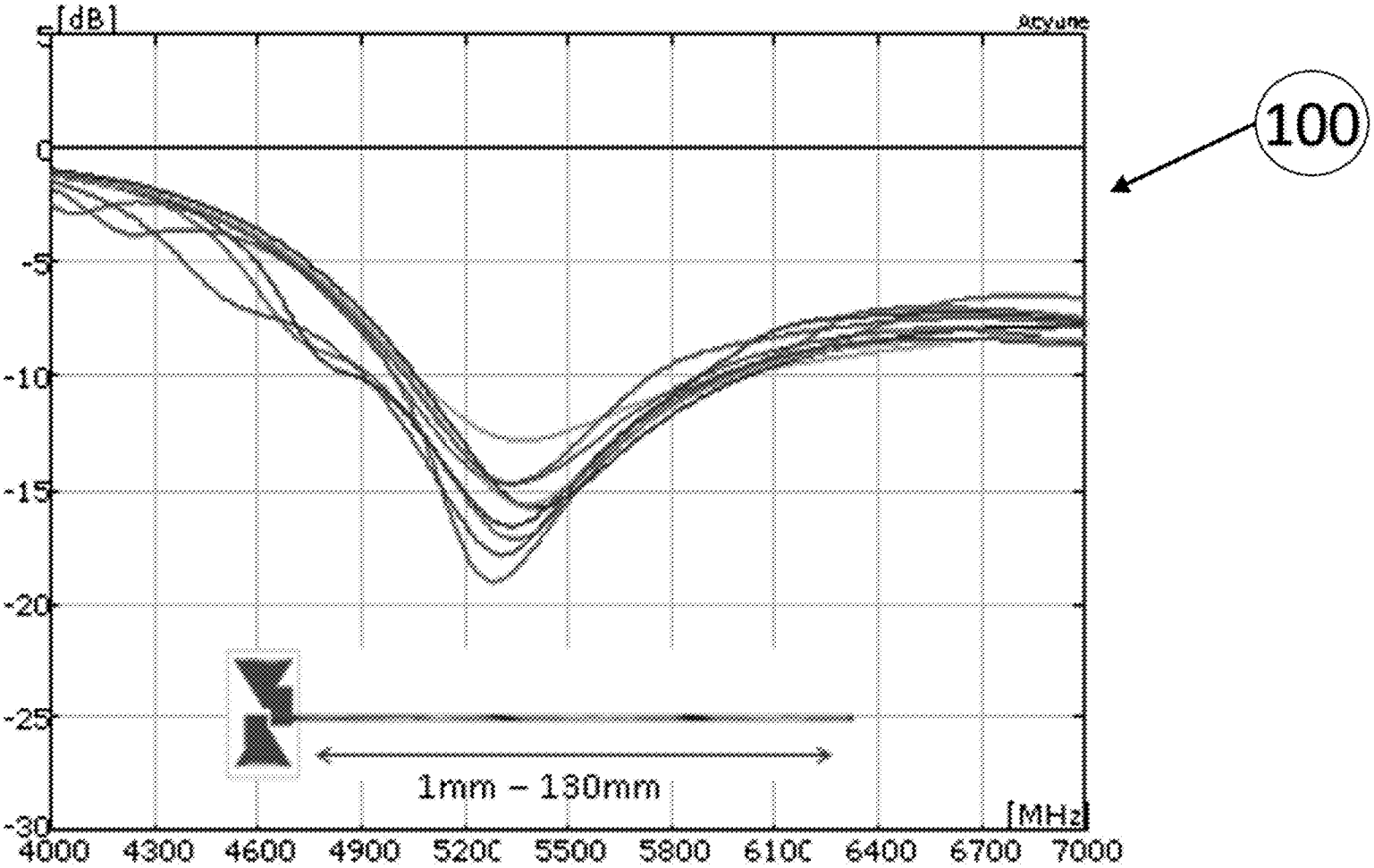
FIG. 10 is graph of an un-balanced fed dipole type antenna varying the cable length.
Figure 11:
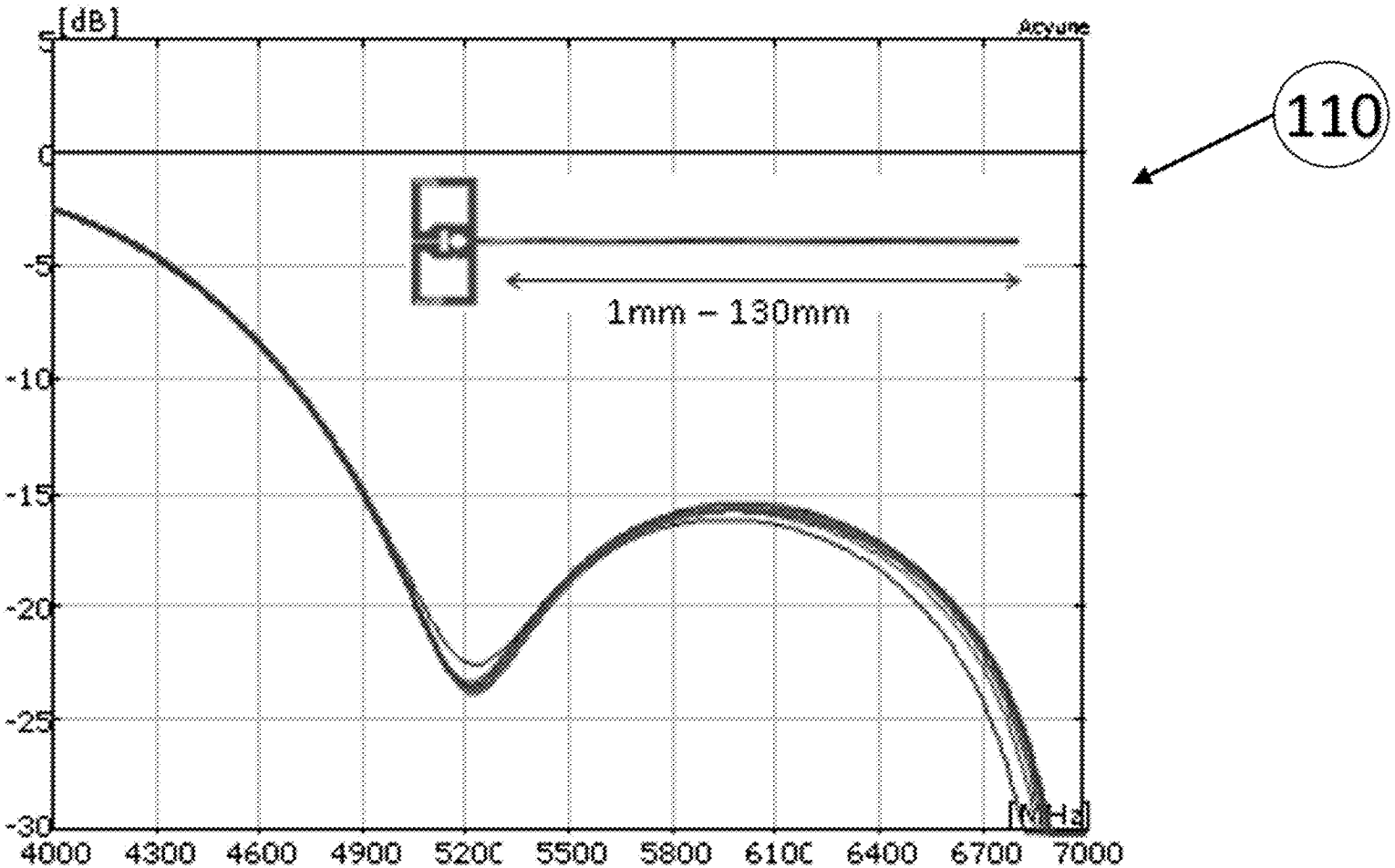
FIG. 11 is a graph of a balanced antenna varying the cable length.

Another demonstration of the effectiveness of the design principle described here is seen analyzing the effect of different cable lengths on the feeding point impedance of the antenna. The graph 100 of FIG. 10 shows the variation of the S11 parameter of a conventional un-balanced fed dipole type antenna as the cable length is varied between 1 mm and 130 mm; the antenna area is 19.0×11.0 mm and the operating frequency is 5500 MHz. For comparison, in the graph 110 of FIG. 11, it is shown the S11 of an antenna of the same size but designed according to the principles proposed here and for the same range of cable lengths. It is clear from the graphs then the proposed design offers a much greater independence of the feeding point impedance from the feeding cable length than a conventional design.

Figure 12:
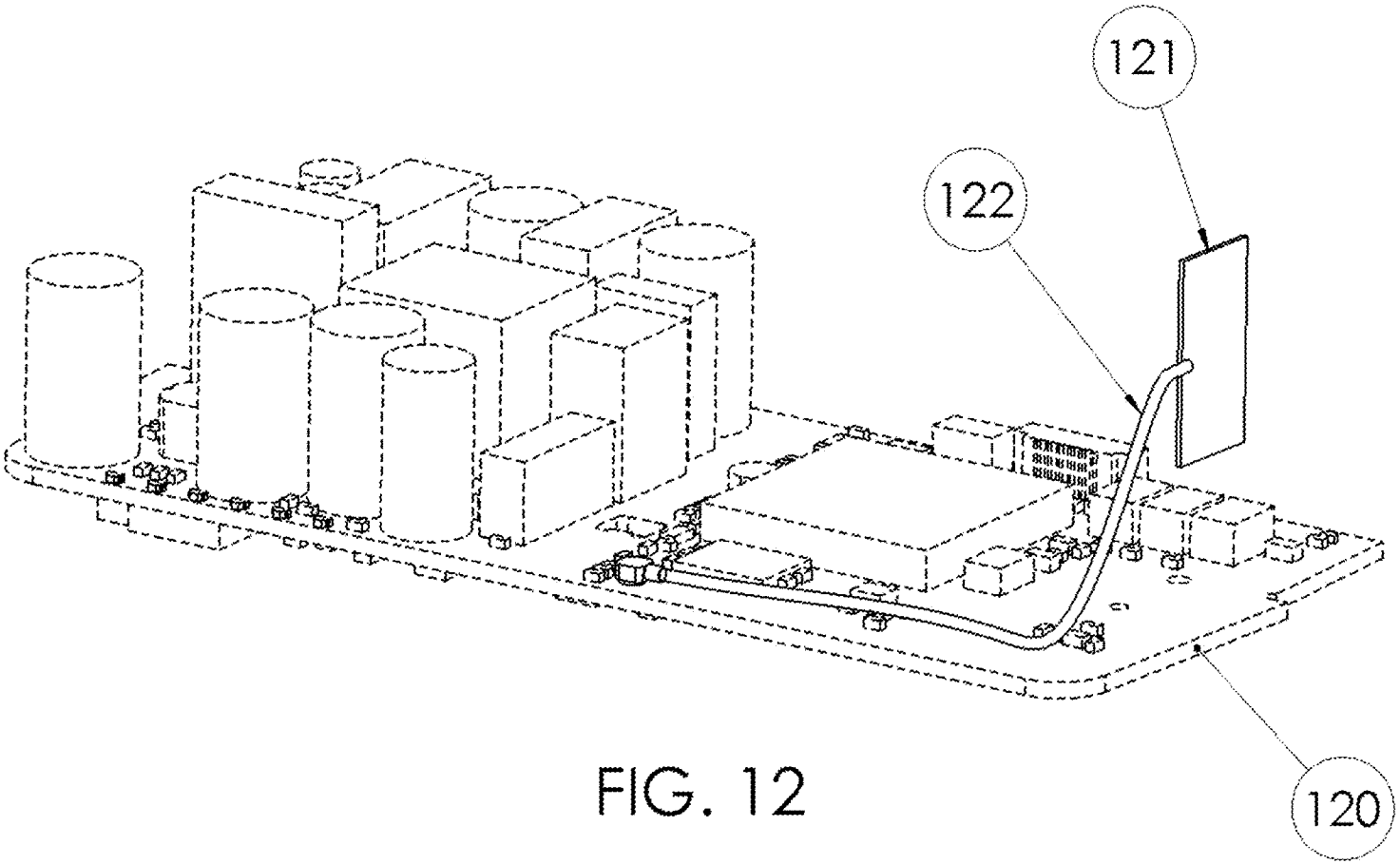
FIG. 12 is an illustration of a coupling of electronic noise or interferers from a PCB to an antenna via a feeding cable.

A further advantage of the proposed idea is related to the noise rejection properties of the balanced antenna. In a typical electronic device utilizing antennas there can be many sources of electromagnetic noise and interferers (clocks, voltage regulators, digital buses, voltage controlled oscillators (VCOs) etc.). If such noise is picked up by the antenna and transferred to the radio receiver it can give raise to several problems like increase in the noise floor and degradation of the receiver sensitivity, desensitization or even blocking of the receiver and other negative effects. As shown in FIG. 12, If the antenna 121 is connected to the receiver 120 or transceiver using a coaxial cable 122 (or another type of transmission line), such cable can pick-up the noise/interferer is passing near its source. The noise/interferer signal can then efficiently propagate towards the antenna in the form of radio-frequency currents on the outer shielding of the cable itself. If the antenna has a poor rejection of the cable currents, the noise/interferer can then easily enter to the inner coaxial transmission line of the cable via the feeding gap and reach the receiver. The phenomenon is illustrated in FIG. 12.

For reciprocity, as the balanced antenna proposed here excites very little current on the feeding cable, it also provides much better rejection of noise and interferers coming from the cables towards the antenna than a conventional design; moreover, as the antenna is intrinsically balanced at any frequency, the effect is present also at frequencies far away from the operating frequencies of the antenna.

Figure 13:
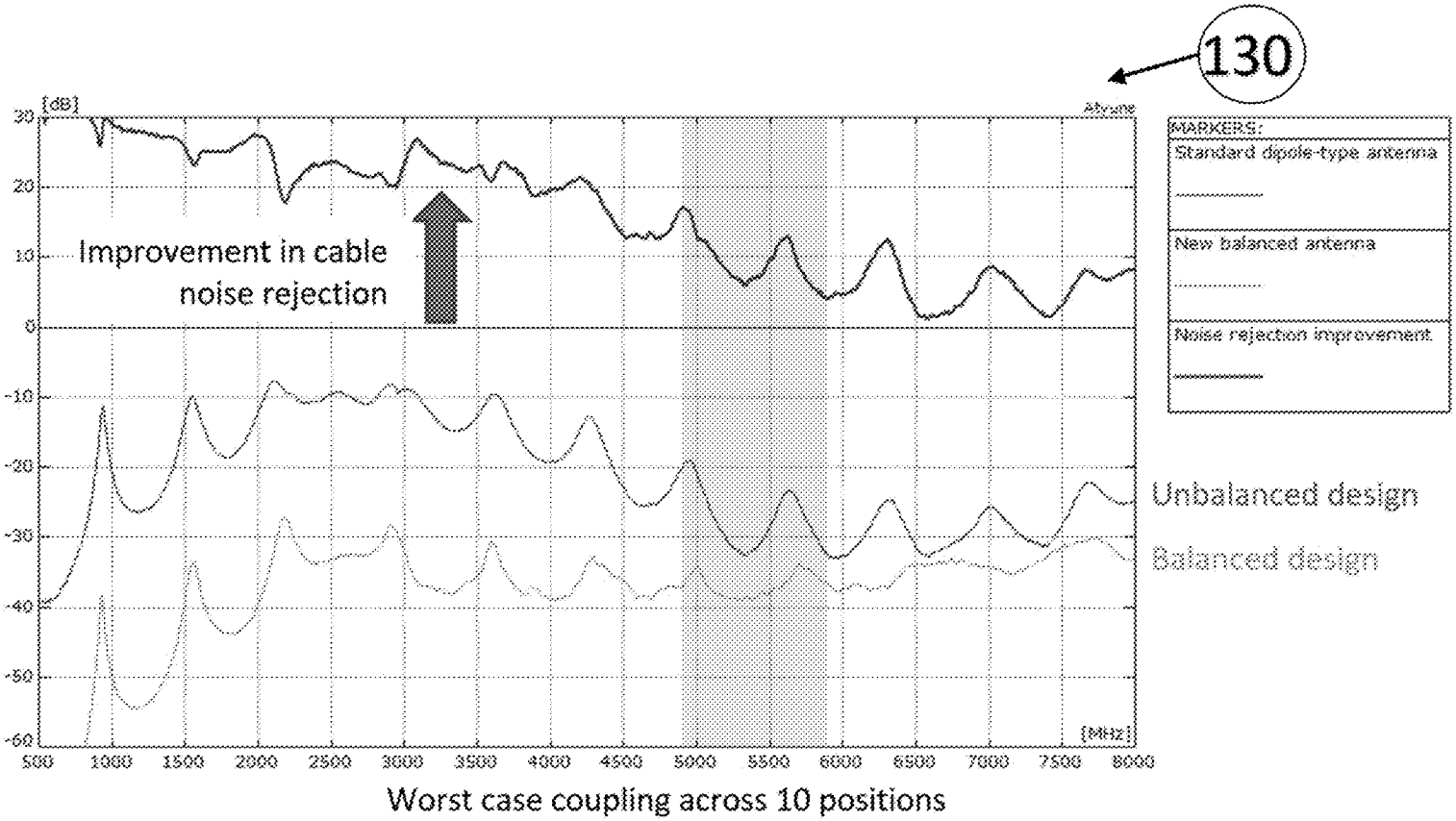
FIG. 13 is a graph that shows a maximum coupling across a wide frequency span between the noise or interferer source and the antenna, comparing a conventional un-balanced dipole type antenna and a balanced antenna.

The effect was demonstrated in an experiment, where the noise or interferer source was simulated by means of a small loop antenna placed near the surface of a PCB in several different positions, and the coupling to the cable-fed antenna was measured. The graph 130 in FIG. 13 shows the maximum coupling across a wide frequency span between the noise or interferer source and the antenna, comparing a conventional un-balanced dipole type antenna and a balanced antenna designed according to the proposed idea; the cable length and position was identical for both antennas. The same graph shows the difference between the two coupling factors, which can be interpreted as the noise rejection improvement provided by the new balanced antenna: it is clear that the new antenna provides a significantly improved noise rejection over a very wide band of frequencies. It is worth noticing that the relative improvement is less in the operating band of the antenna (4900 MHz to 5900 MHz in the example) as in that case most of the coupling occurs directly over the air.

Figure 14:
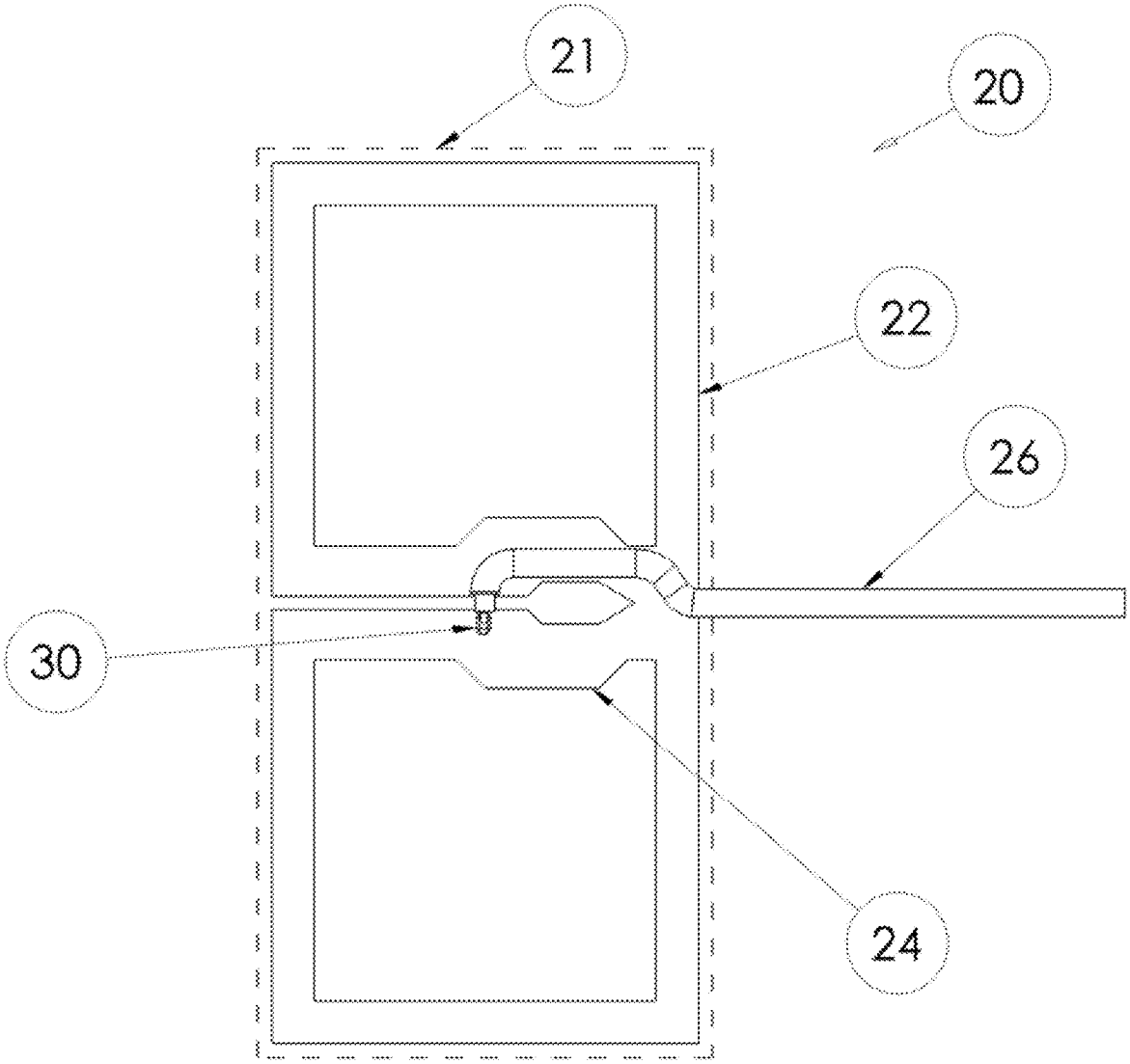
FIG. 14 is an illustration of an embodiment of a balanced antenna.
Figure 14A:
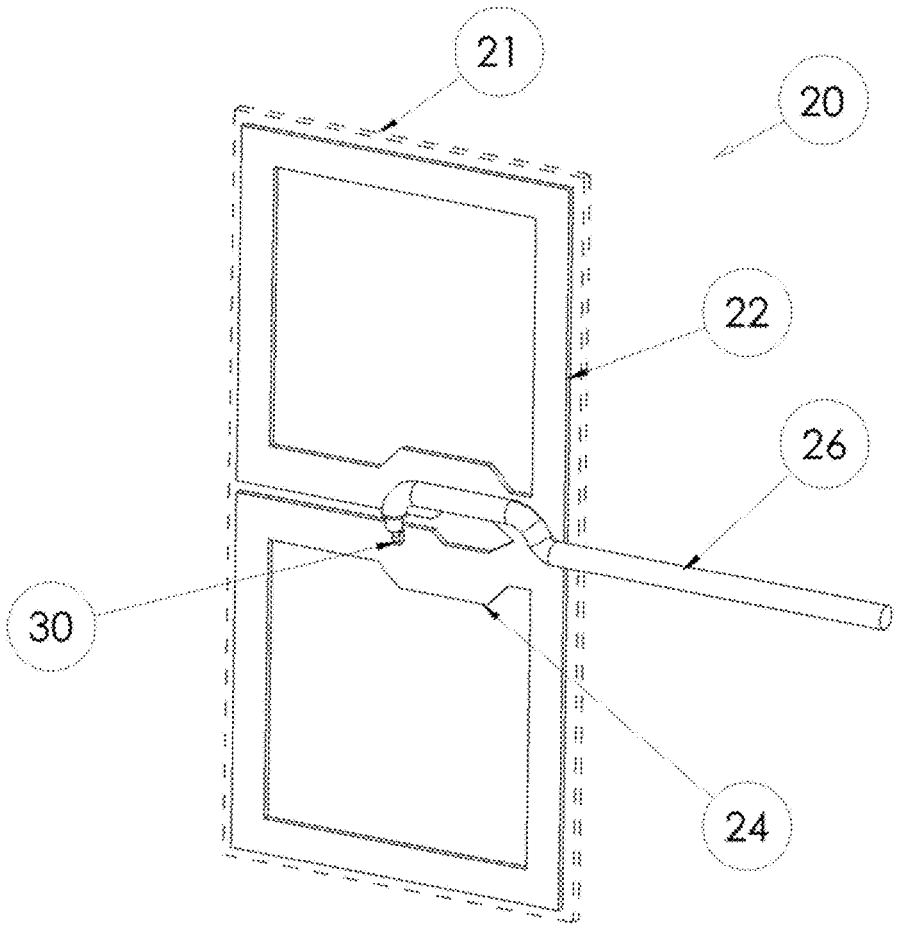
FIG. 14A is an illustration of an embodiment of a balanced antenna.

A first embodiment of the invention is illustrated in FIGS. 14 and 14A. In this embodiment, the antenna 20 has both the outer and the inner infinite baluns 22 and 24 are on the same layer. The feeding cable 26 enters the antenna 20 along the symmetry axis and then runs along one of the arm of the inner balun 24 to reach the feeding gap 30; the outer shielding of the cable 26 is electrically connected to the inner balun 24 conductor; at the feeding gap 30 the inner core of the coaxial cable 26 is exposed and electrically connected to the other arm of the inner balun 24 across the gap 30. Unlike the well-known loop antenna with infinite balun, the cable 26 does not run along the longer outer perimeter of the loop.

Figure 15:
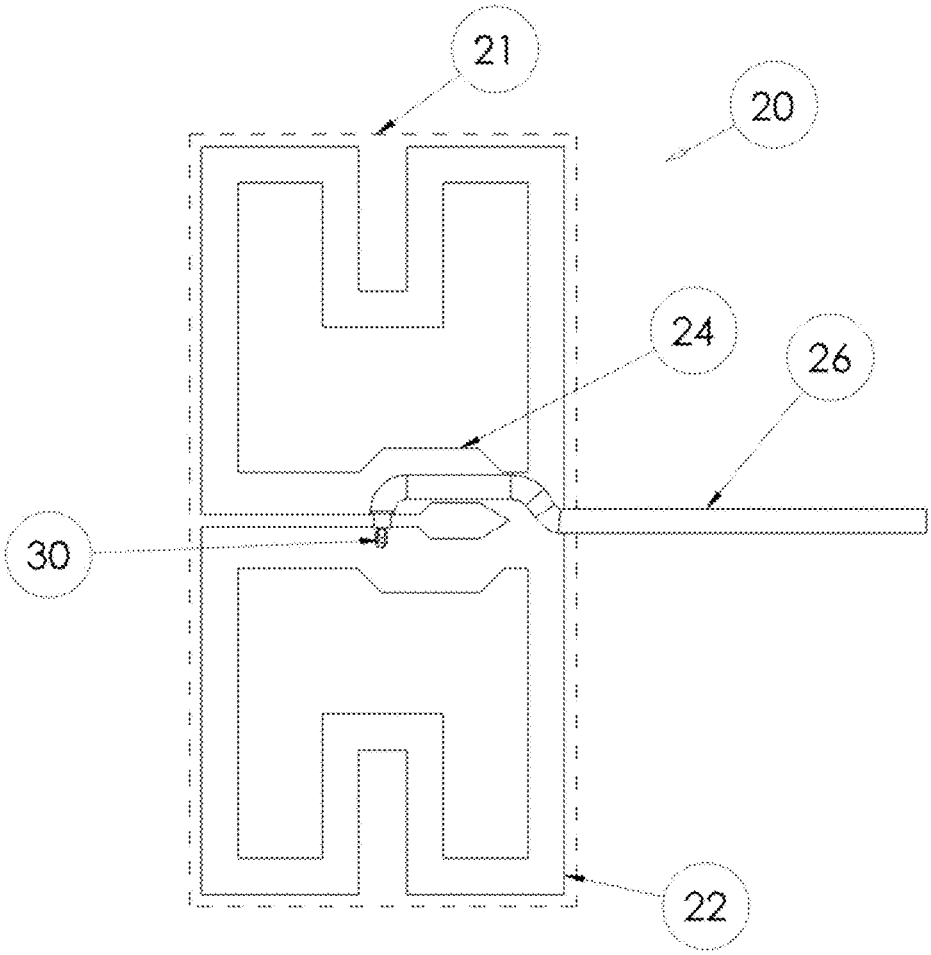
FIG. 15 is an illustration of a second embodiment of a balanced antenna with meandered outer loop.
Figure 15A:
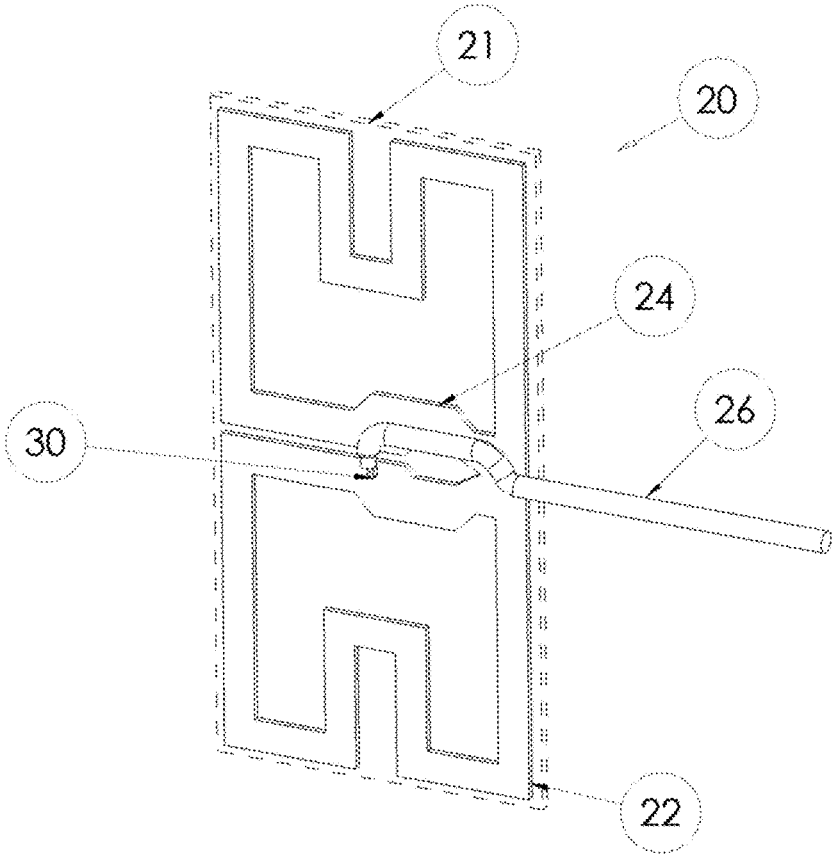
FIG. 15A is an illustration of a second embodiment of a balanced antenna with meandered outer loop.

In a second embodiment of the antenna, illustrated in FIGS. 15 and 15A, the shape of the outer loop is changed to alter the resonant frequency of the antenna or its impedance at a given frequency; for instance the outer loop can be meandered to make it electrically longer and lower resonant frequency without increasing the overall size of the antenna 20.

Figure 16:
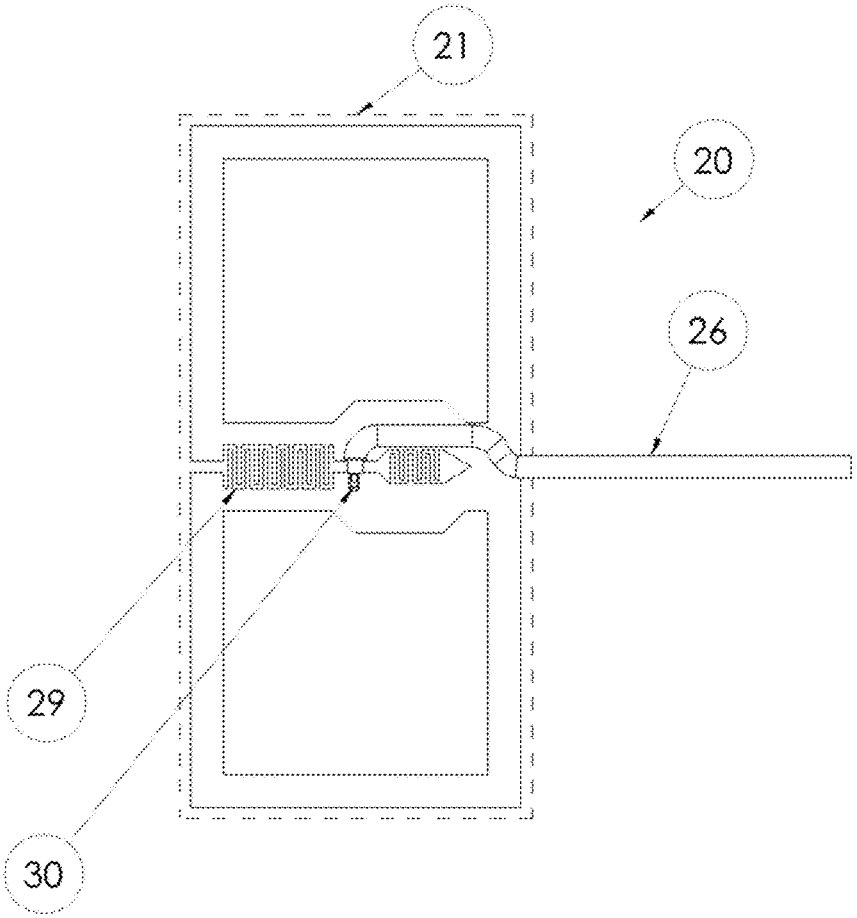
FIG. 16 is an illustration of an embodiment of a balanced antenna with interdigital capacitors.
Figure 16A:
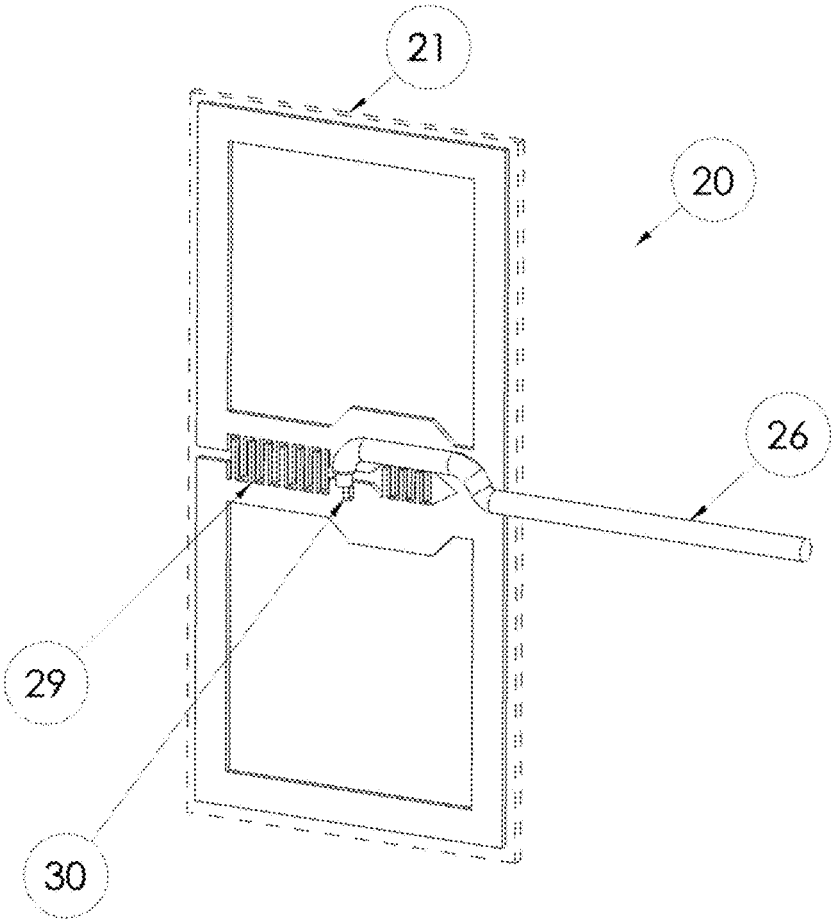
FIG. 16A is an illustration of an embodiment of a balanced antenna with interdigital capacitors.

In another embodiment of the invention, illustrated in FIGS. 16 and 16A, the resonant frequency and the feed point impedance of the antenna 20 is adjusted by inserting an interdigital capacitor 29 between the two arms of the inner or outer infinite balun 22 and 24. The infinite baluns 22 and 24 are on the same layer of the base 21.

In another embodiment of the antenna, lumped passive components (inductors or capacitors) are added to the antenna to modify its resonant frequency or feed point impedance.

Figure 17:
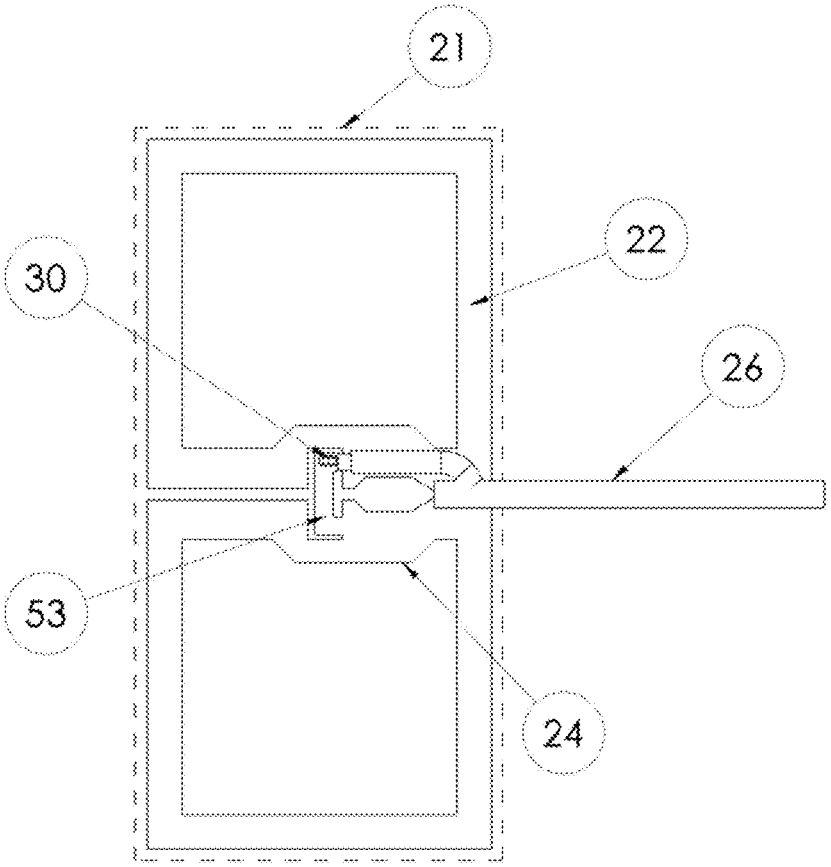
FIG. 17 is an illustration of a balanced antenna with a part of a cable replaced by a CPW.
Figure 18:
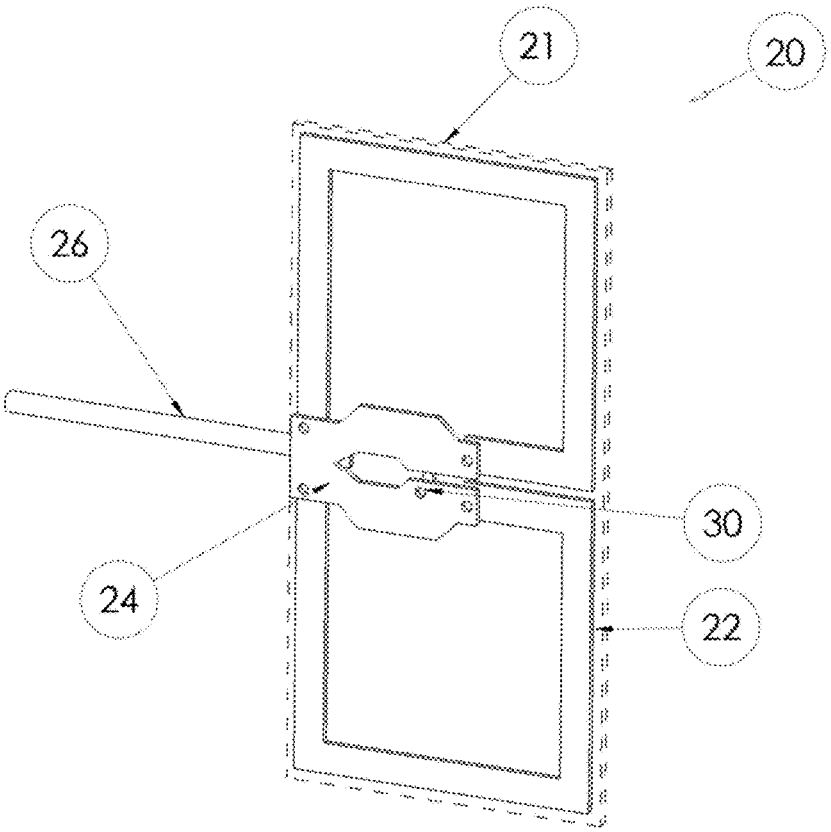
FIG. 18 is an illustration of a balanced antenna on a two layer PCB with an inner balun on a bottom layer.
Figure 18A:
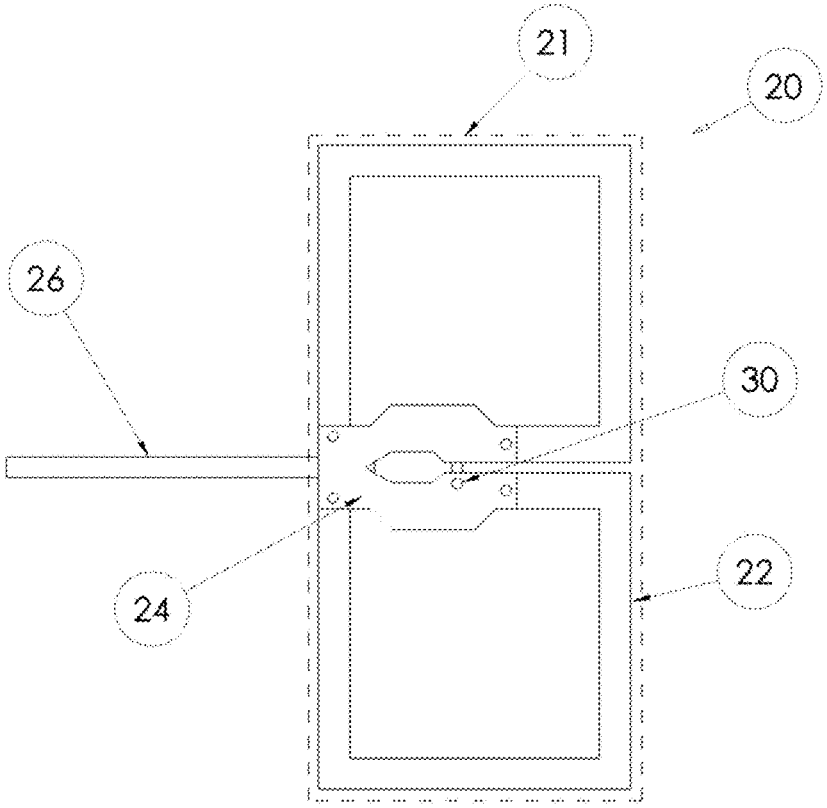
FIG. 18A is an illustration of a balanced antenna on a two layer PCB with an inner balun on a bottom layer.
Figure 18B:
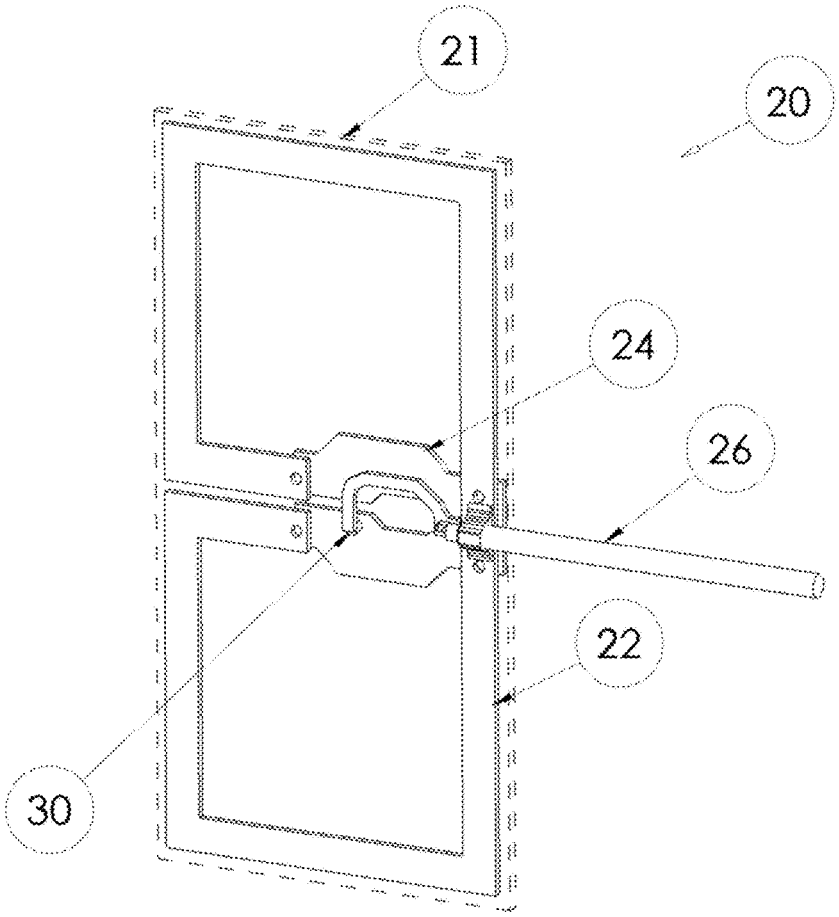
FIG. 18B is an illustration of a balanced antenna on a two layer PCB with an inner balun on a bottom layer.
Figure 18C:
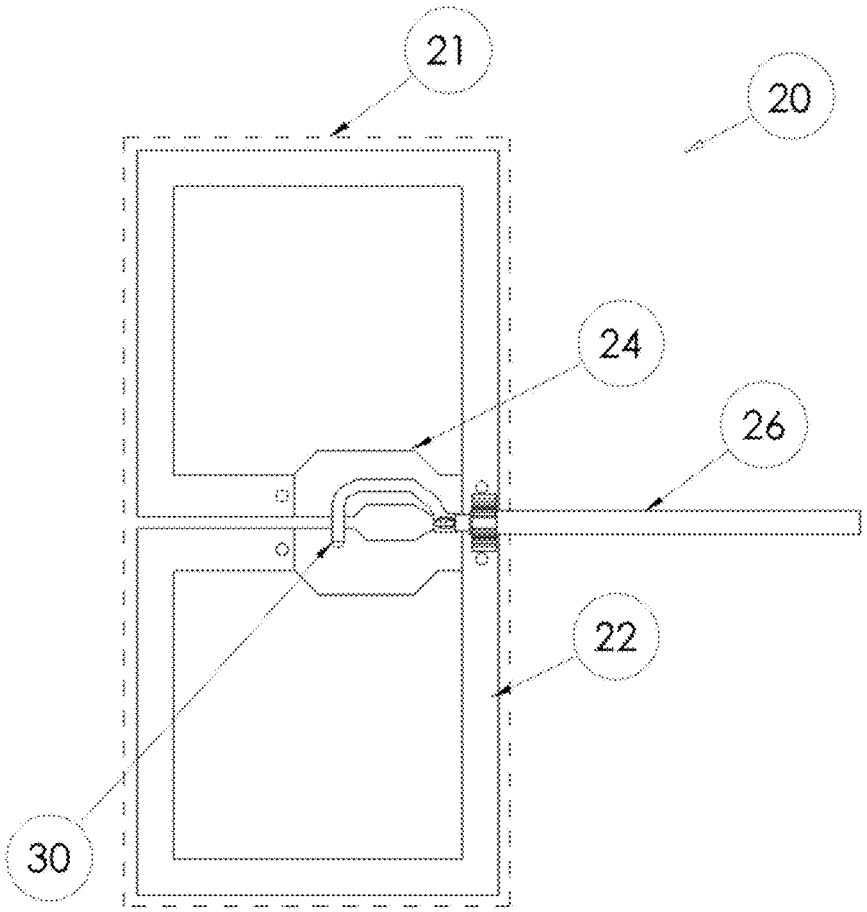
FIG. 18C is an illustration of a balanced antenna on a two layer PCB with an inner balun on a bottom layer.
Figure 19:
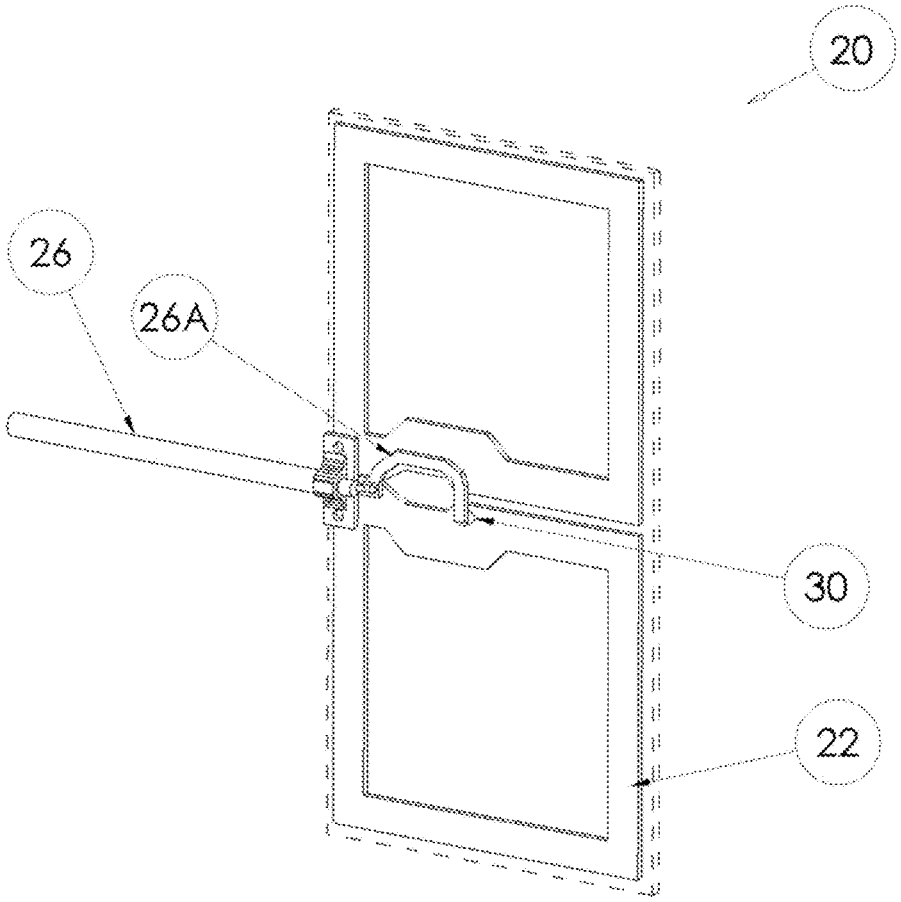
FIG. 19 is an illustration of a balanced antenna on a two layer PCB with outer and inner balun and a cable on a top layer, and a microstrip feeding line a bottom layer.
Figure 19A:
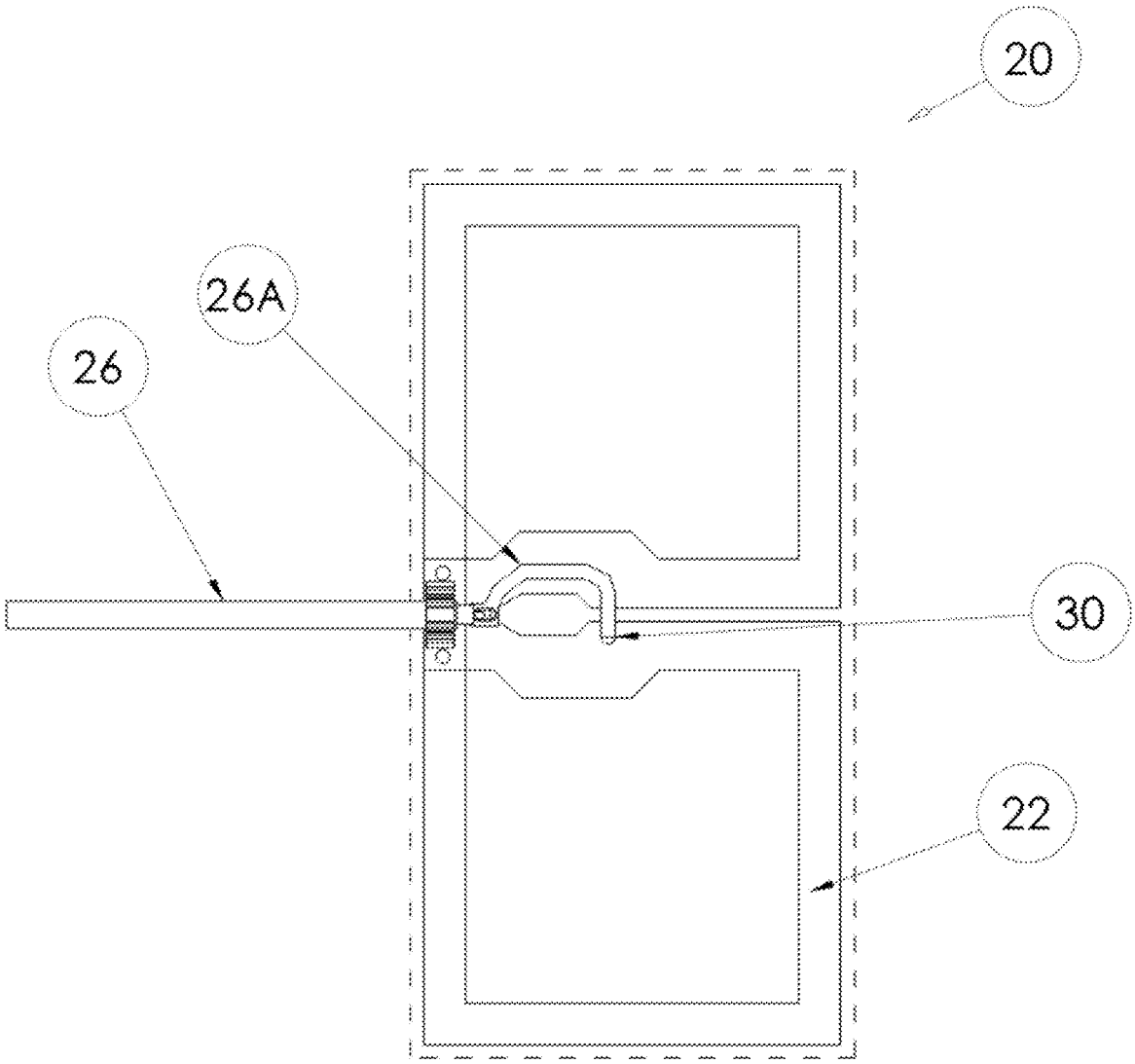
FIG. 19A is an illustration of a balanced antenna on a two layer PCB with outer and inner balun and a cable on a top layer, and a microstrip feeding line a bottom layer.
Figure 19B:
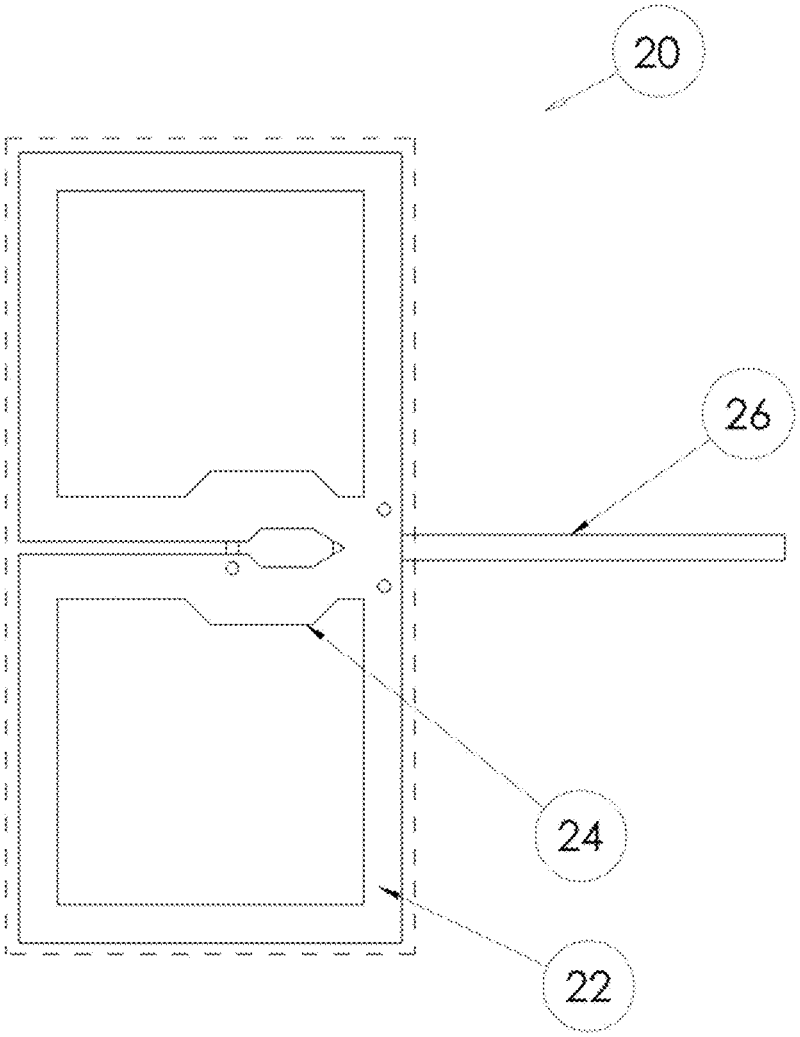
FIG. 19B is an illustration of a balanced antenna on a two layer PCB with outer and inner balun and a cable on a top layer, and a microstrip feeding line a bottom layer.
Figure 19C:
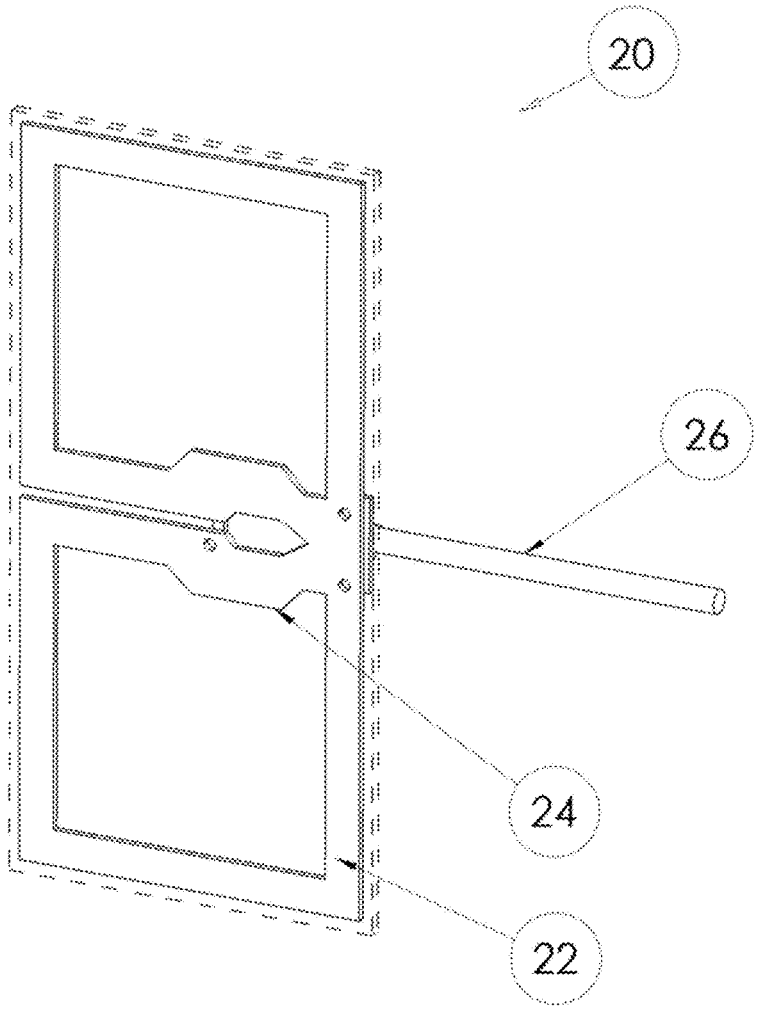
FIG. 19C is an illustration of a balanced antenna on a two layer PCB with outer and inner balun and a cable on a top layer, and a microstrip feeding line a bottom layer.
Figure 20:
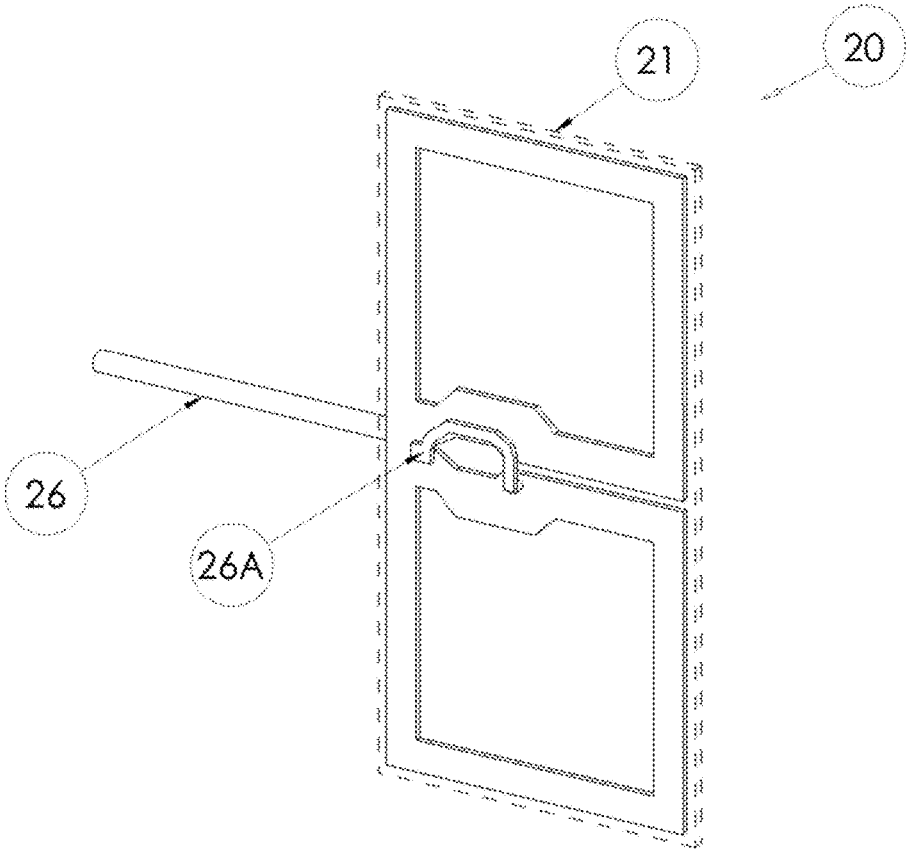
FIG. 20 is an illustration of a balanced antenna on a two layer PCB with outer and inner balun and a cable on a top layer, and a microstrip feeding line a bottom layer.
Figure 20A:
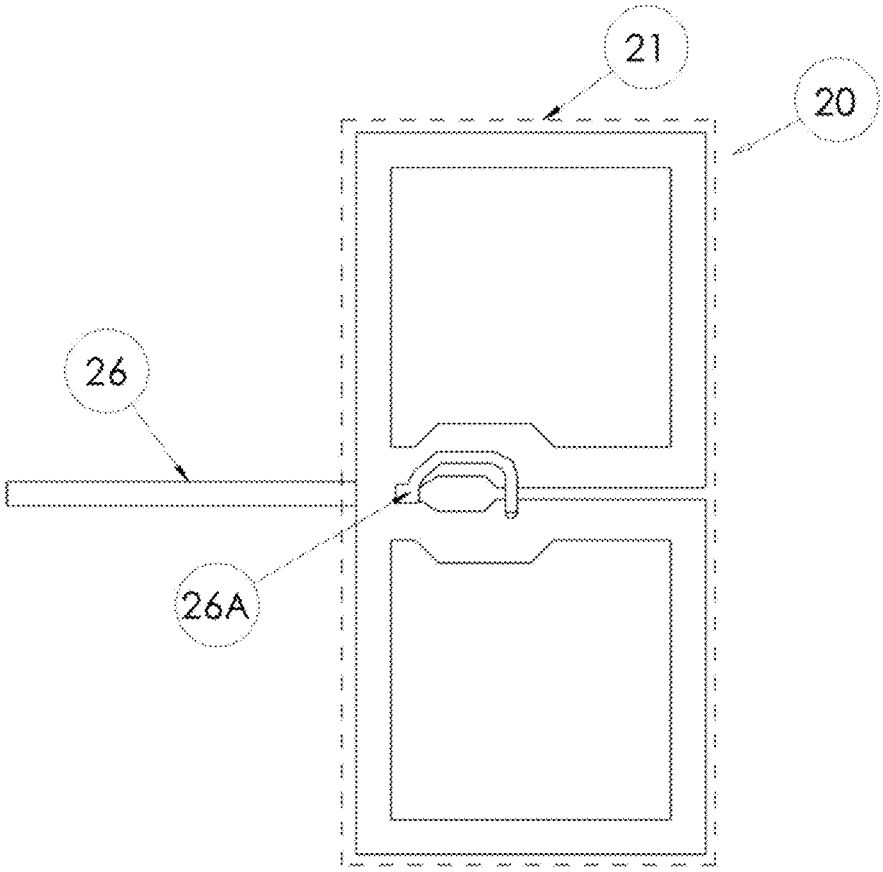
FIG. 20A is an illustration of a balanced antenna on a two layer PCB with outer and inner balun and a cable on a top layer, and a microstrip feeding line a bottom layer.
Figure 20B:
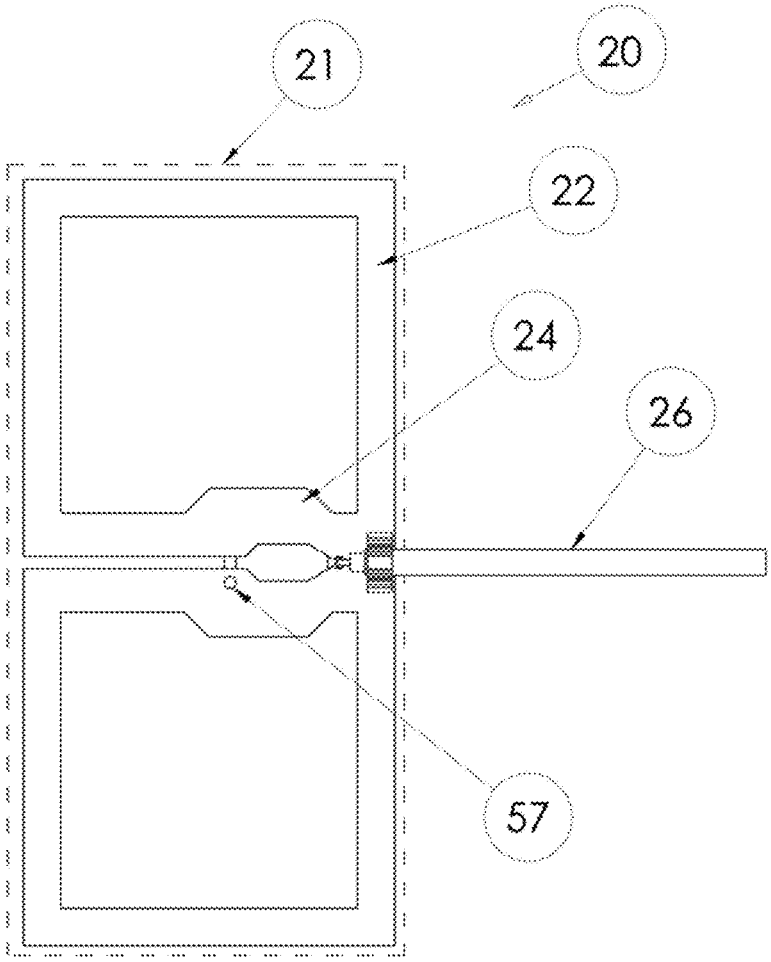
FIG. 20B is an illustration of a balanced antenna on a two layer PCB with outer and inner balun and a cable on a top layer, and a microstrip feeding line a bottom layer.
Figure 20C:
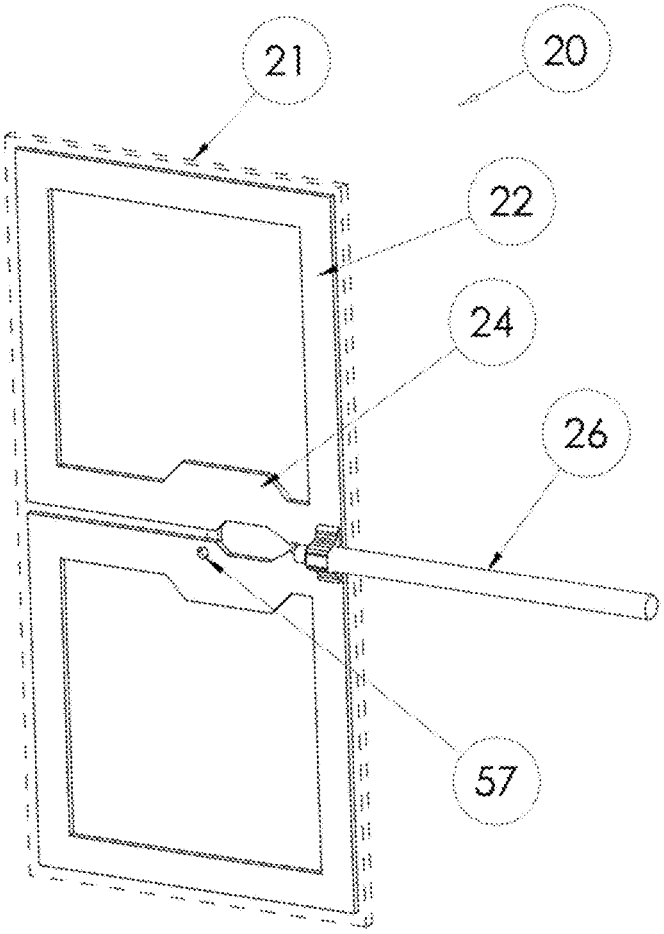
FIG. 20C is an illustration of a balanced antenna on a two layer PCB with outer and inner balun and a cable on a top layer, and a microstrip feeding line a bottom layer.

In another embodiment of the antenna, illustrated in FIGS. 17 and 17A, part of the cable 26 close to the feeding gap 30 is replaced by a Co-Planar Waveguide (CPW) 53 or similar transmission line in order to reduce the length and the bending of the feeding cable 26.

In another embodiment, illustrated in FIGS. 18, 18A, 18B and 18C, the outer balun 22 is realized on one layer (e.g. top layer of a PCB 21), while the inner balun 24 is realized on a different layer (e.g. bottom layer of the PCB 21); the two layers can be separated by a dielectric layer; the two baluns 22 and 24 are electrically connected together in the area where they overlap, for instance by means of plated via holes; the part of the coaxial cable 26 which runs along one arm of the inner balun is replaced by either a microstrip line running on the same layer of the outer layer, or by a strip-line running on an intermediate layer, or another type of transmission line; the cable 26 can be straight and its outer shielding is electrically connected to the balun conductor on the first layer, while the inner core of the cable 26 is electrically connected to the transmission line. In this way it is not necessary to pre-form or bend the coaxial cable 26 and electrically connect it to the inner balun 24 along its path.

In an alternative embodiment, illustrated in FIGS. 19, 19A, 19B and 19C, both the inner 24 and outer baluns 22 are on the same layer but the coaxial cable 26 is placed on a different layer; the outer shielding of the cable 26 is electrically connected to the conductors on the first layer, for instance by means of plated via holes, while the inner core of the cable is connected to a microstrip line 26*a* or similar transmission line which runs parallel to one arm of the inner balun 24, crosses the gap and then is electrically connected to the second arm of the inner balun 24, for instance by means of another plated via hole.

In an alternative embodiment, illustrated in FIGS. 20, 20A, 20B and 20C, both the inner balun 24 and outer balun 22 are on the same layer and also outer shielding of the coaxial cable 26 is electrically connected directly to the same layer; the inner core of the cable 26 is then connected, by elongating it or by means of a plated via hole or similar, to a microstrip line 26*a* or similar transmission line on a different layer which runs parallel to one arm of the inner balun 24, crosses the gap 30 and then is electrically connected to the second arm of the inner balun 24, for instance by means of a via hole 57.

Figure 21:
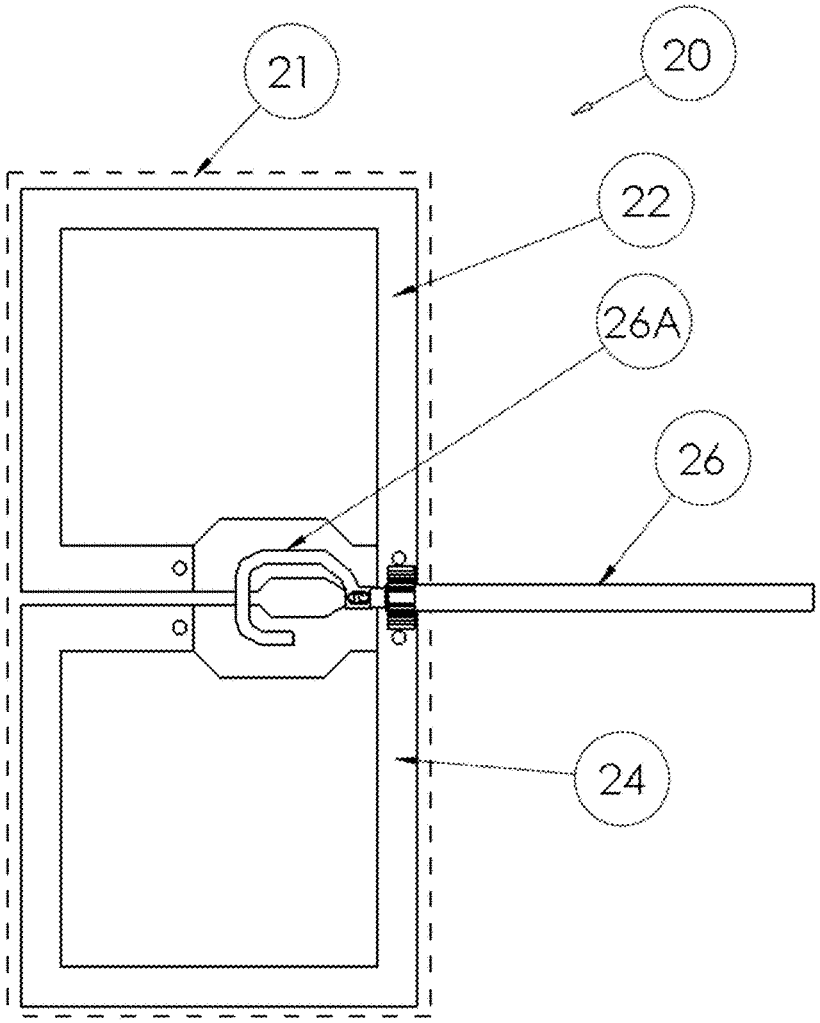
FIG. 21 is an illustration of a balanced antenna on a two layer PCB with an open ended microstrip feeding line.

In another embodiment similar to the previous two, the end of the microstrip line 26*a* is not galvanically connected to the inner balun 24 or outer balun 26, but rather left open in a way similar to a Marchand balun, as illustrated in FIG. 21.

Figure 22:
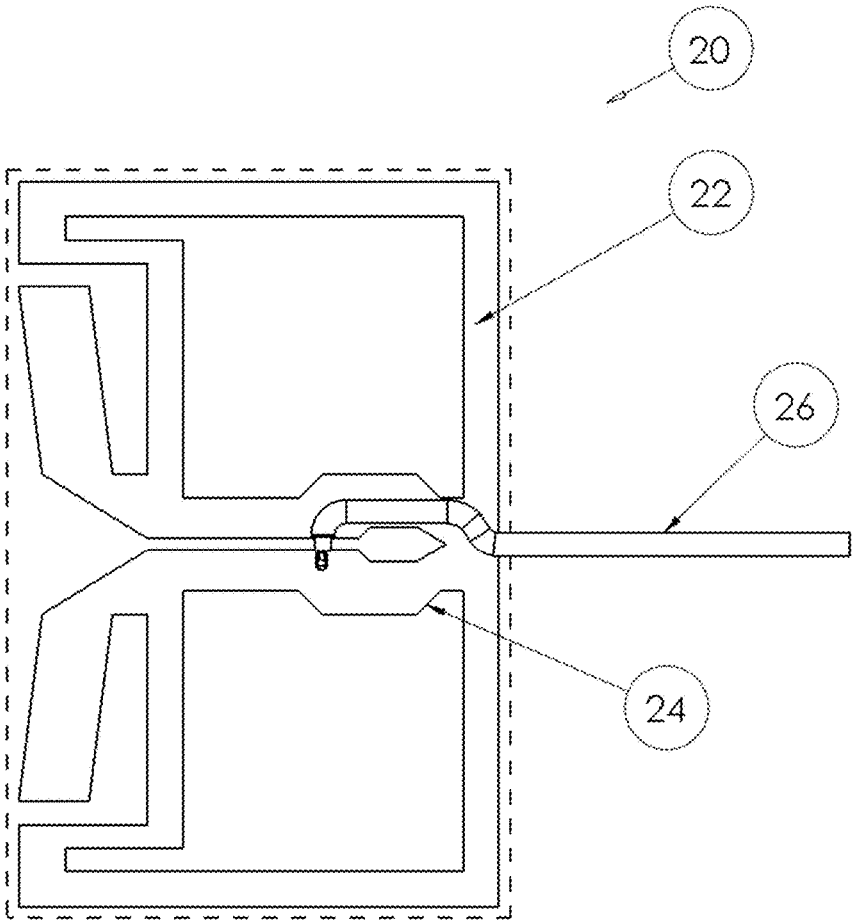
FIG. 22 is an illustration of a multiple band balanced antenna design.

In another embodiment, the outer loop is modified by adding conducting structures and features so that the antenna, beside resonating at the fundamental mode determined by the electrical length of the outer balun 22 loop, it also resonates at one or more higher frequency modes; as long as the electrical symmetry of the antenna is preserved, the antenna will remain balanced even at the higher frequency modes. In FIG. 22, an example of balanced antenna 20 resonating at two well separated frequencies is given.

Figure 23:
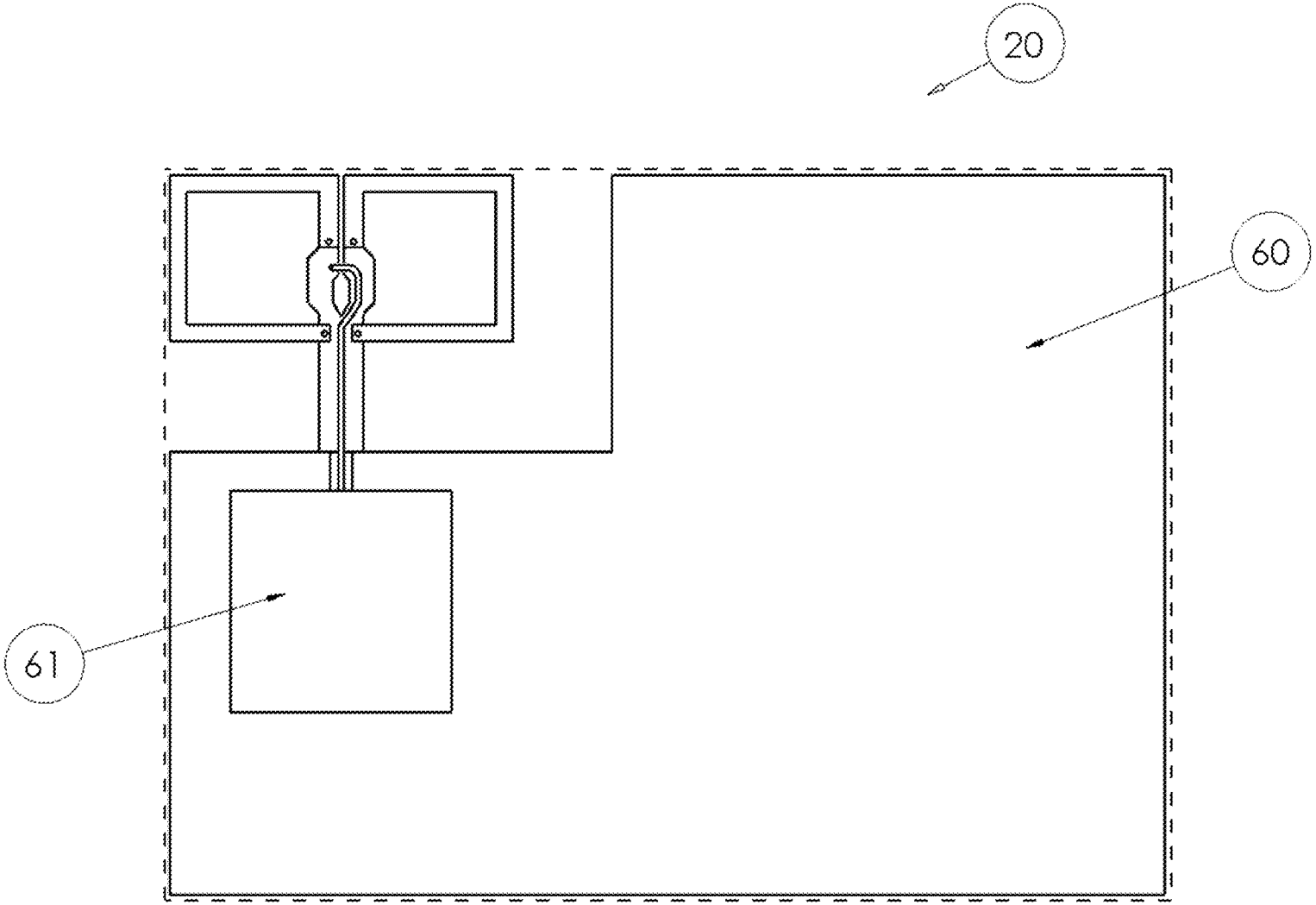
FIG. 23 is an illustration of a balanced antenna inserted into a PCB and connected to a radio transceiver using a microstrip.
Figure 23A:
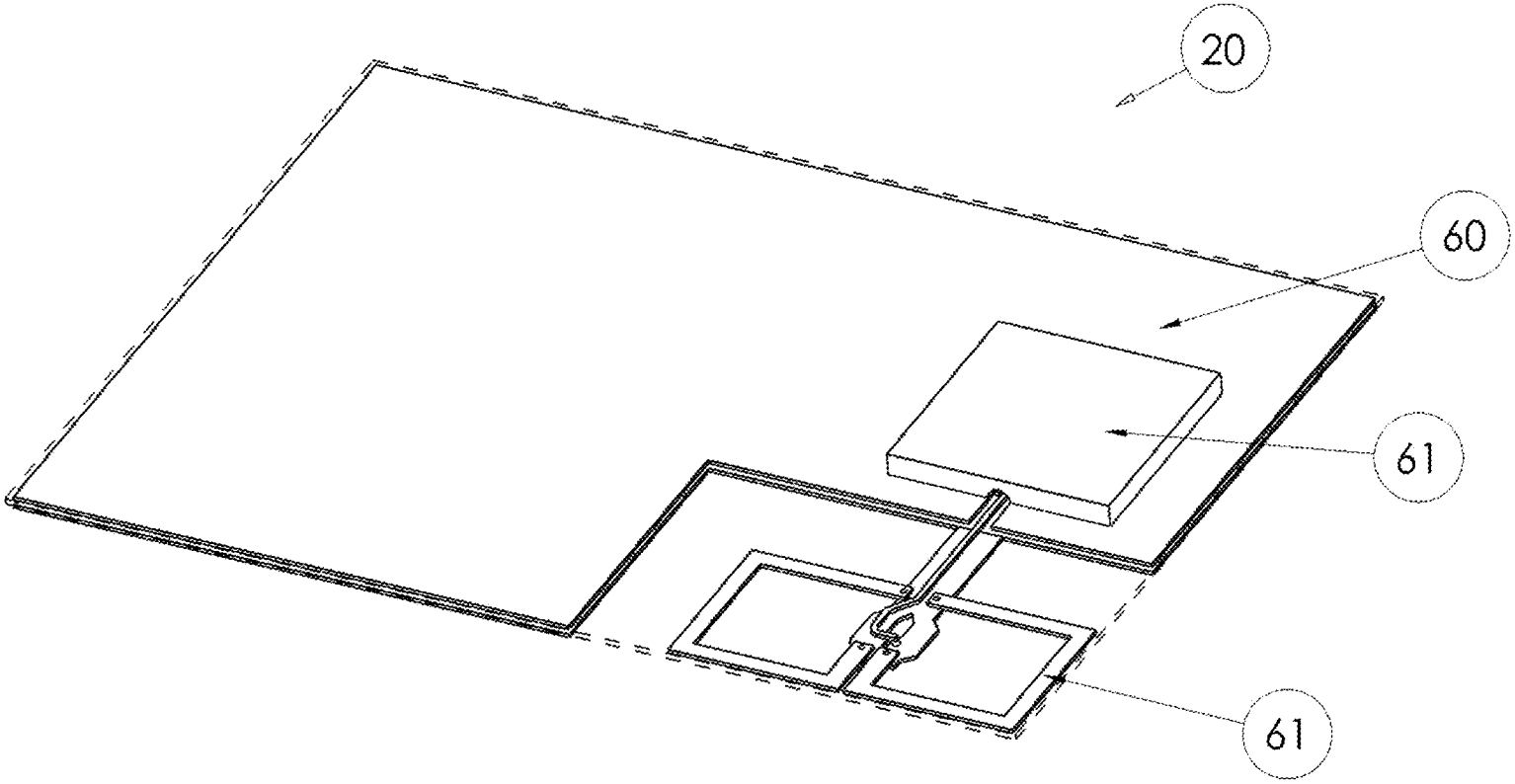
FIG. 23A is an illustration of a balanced antenna inserted in a larger PCB and connected to a radio transceiver using a microstrip.

In all the above embodiments, the "coaxial cable" 26 has to be intended interchangeable with any other type of microwave transmission line (e.g. Microstrip line 26*a*, stripline, CWP). For instance, the balanced antenna 20 could be realized as part of a larger PCB 60 which contains the radio transceiver and other electronic components, the balanced antenna 20 could then be connected to the radio front-end by means 61 of a microstrip line or a stripline, provided the electrical symmetry is preserved in the grounding connection. An example of this embodiment is illustrated in FIGS. 23 and 23A.

Figure 24:
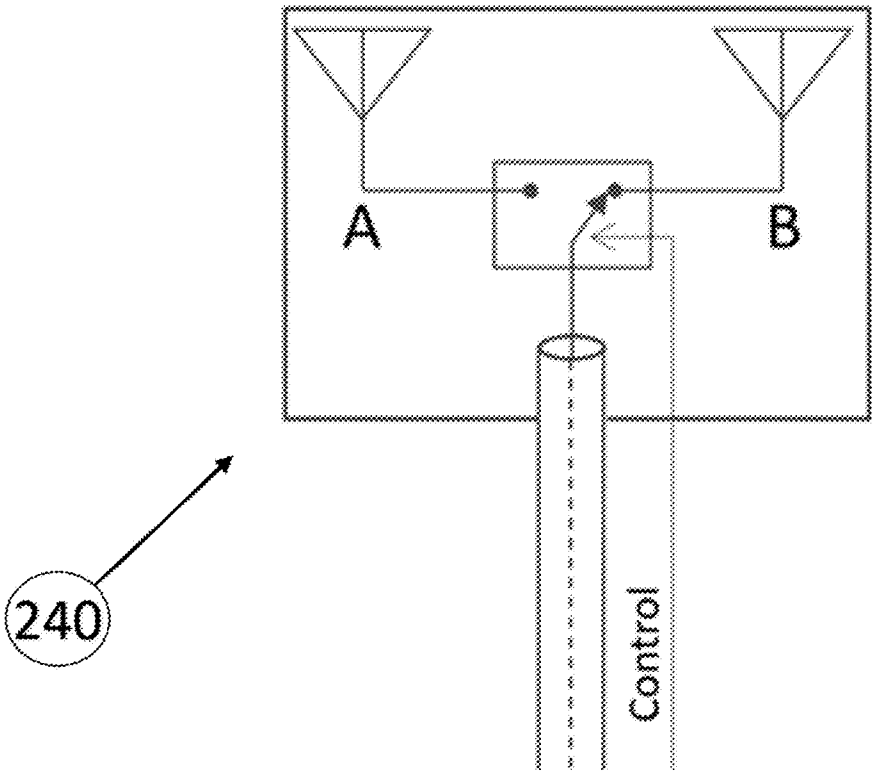
FIG. 24 is a schematic representation of an electronically switchable antenna arrangement, wherein A and B represent two balanced antennas.
Figure 25:
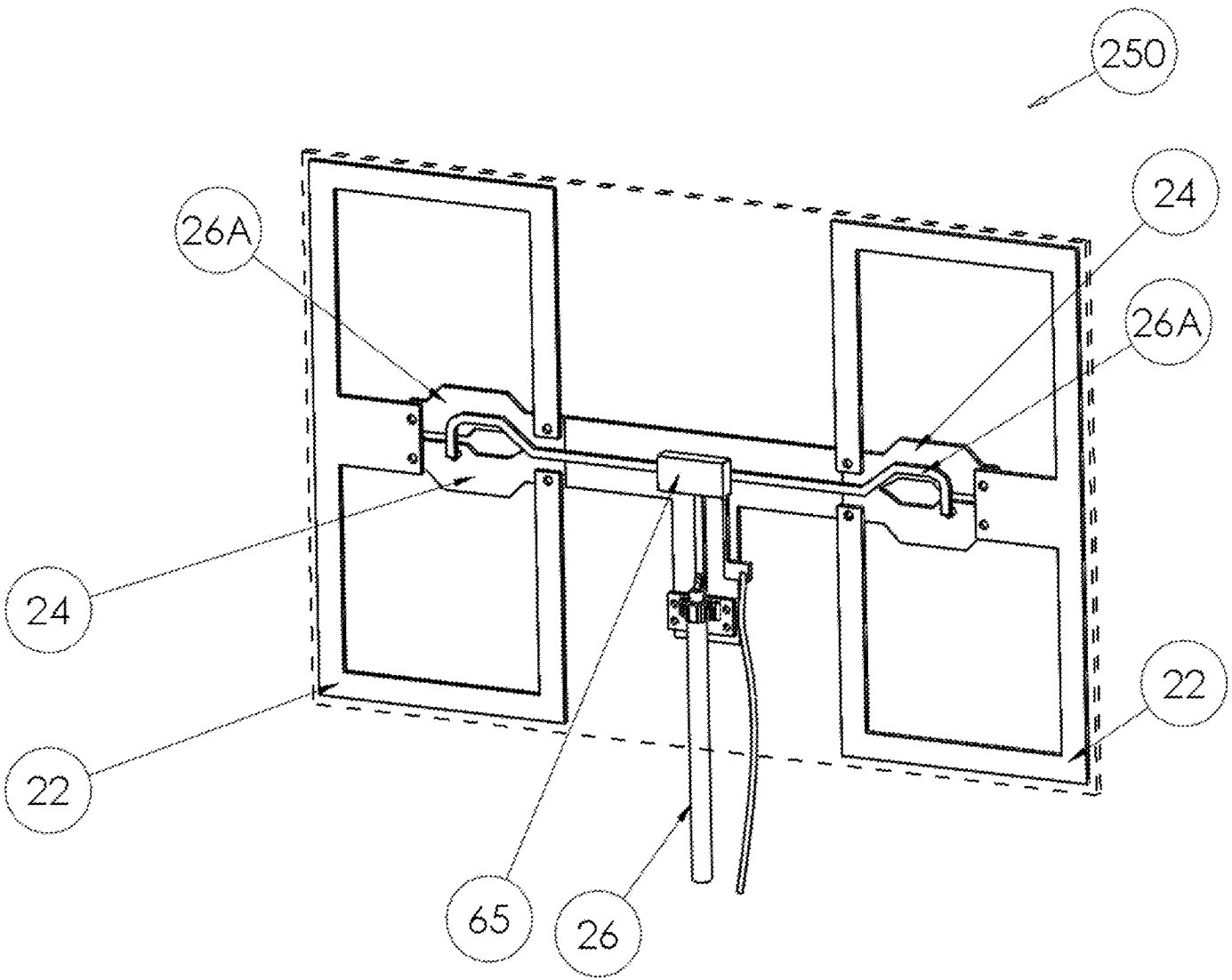
FIG. 25 is an illustration of a switchable balanced antenna mirrored pair with a RF switch and separate control lines.
Figure 26:
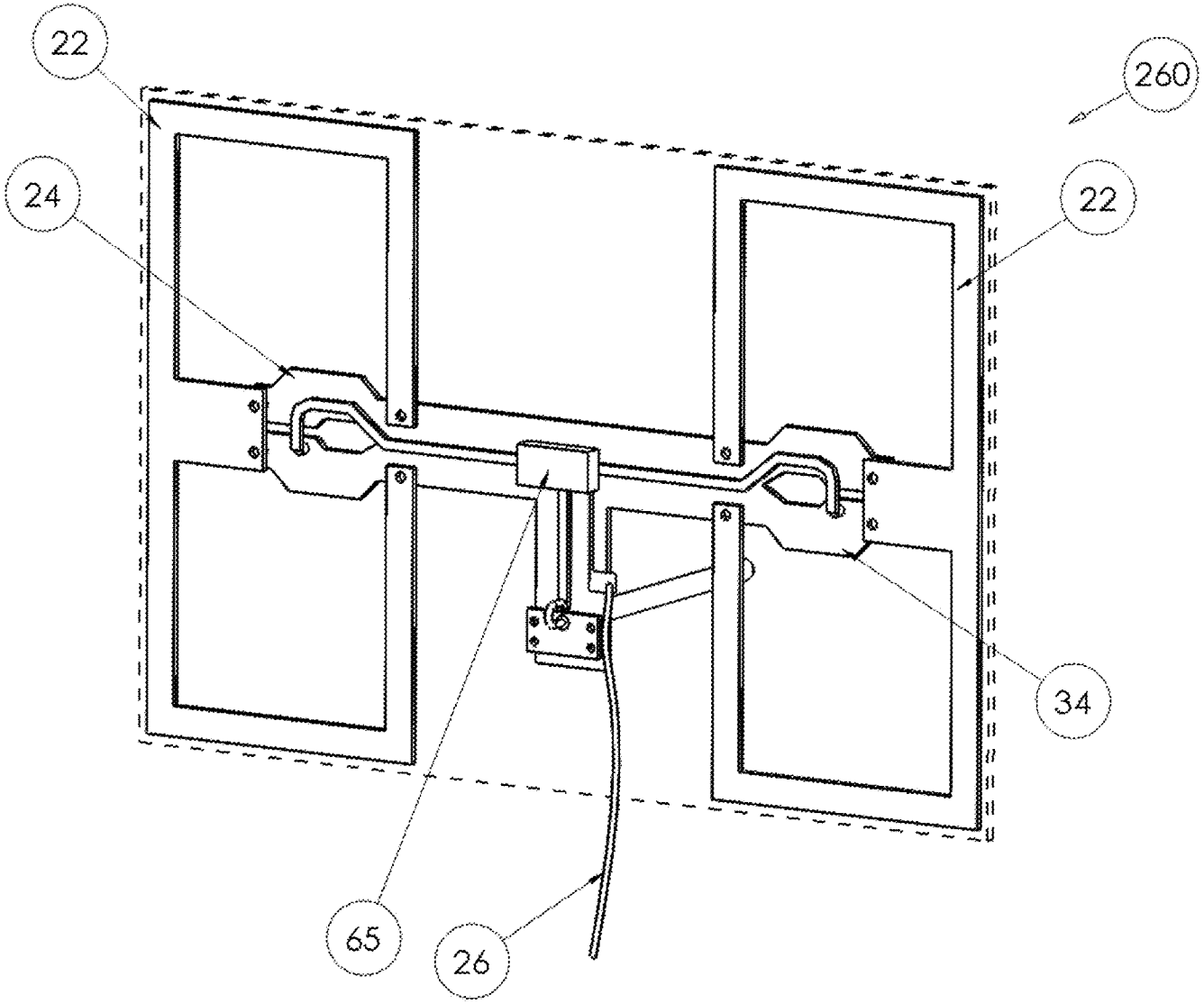
FIG. 26 is an illustration of a switchable balanced antenna pair with a coaxial cable orthogonal to the antennas' plane.
Figure 26A:
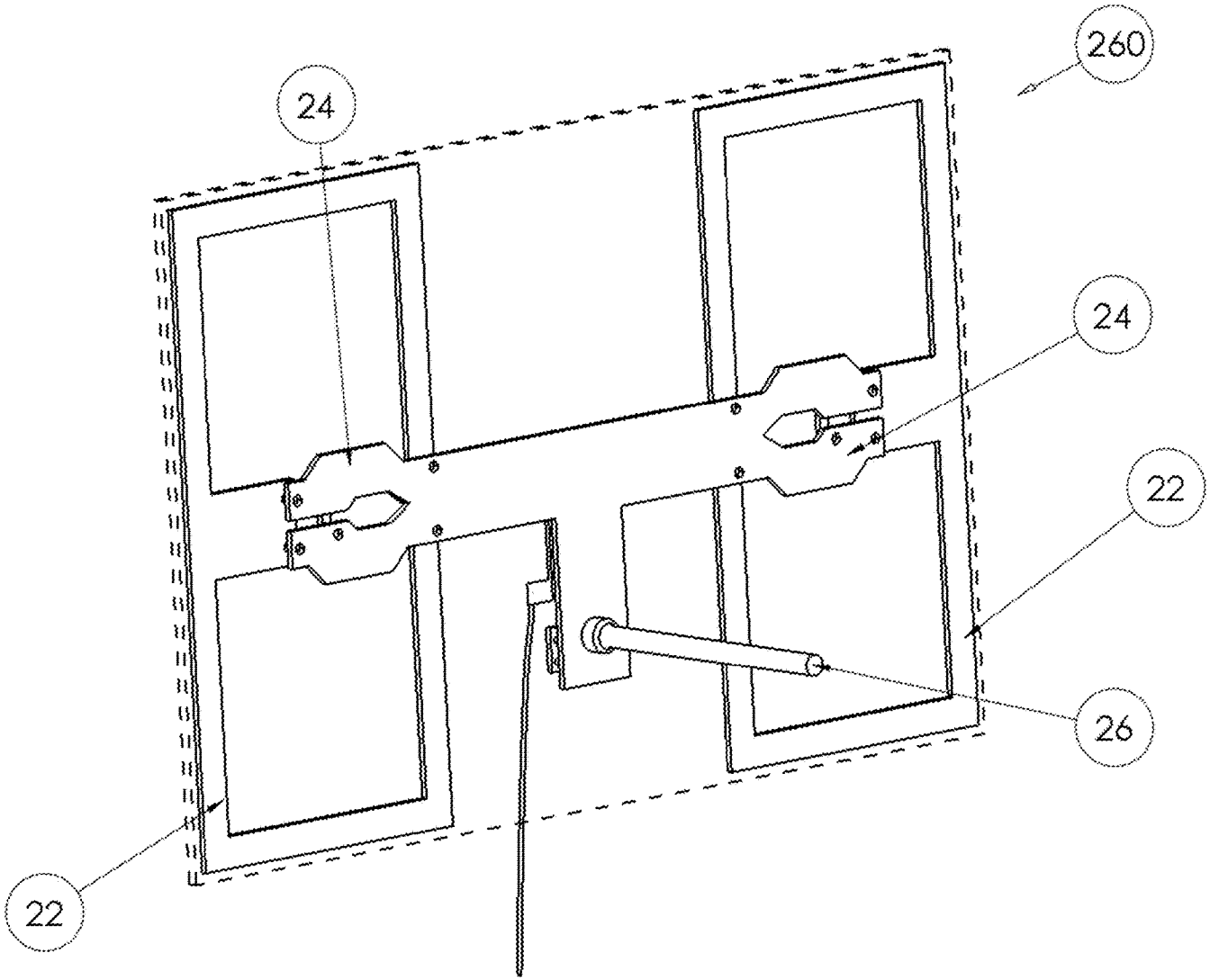
FIG. 26A is an illustration of a switchable balanced antenna pair with a coaxial cable orthogonal to the antennas' plane.

As the antenna disclosed here is self-balanced and decoupled from the transmission line used to feed it, it is particularly suitable for using to create compact multi antenna modules for diversity or smart-antenna applications. In a first example of a compact multi-antenna module 240, schematically represented in FIG. 24, two antennas A and B are arranged in a mirrored planar configuration, preferably using PCB technology, separated by a narrow area containing an RF switch for selecting which antenna is momentarily connected to the radio transceiver via a coaxial cable or other transmission line. The feeding cable 26 can exit in the same plane as the antennas of the compact multi-antenna module 250 shown in FIG. 25, or perpendicularly to the plane as in the compact multi-antenna module 260 shown in FIG. 26.

Figure 27:
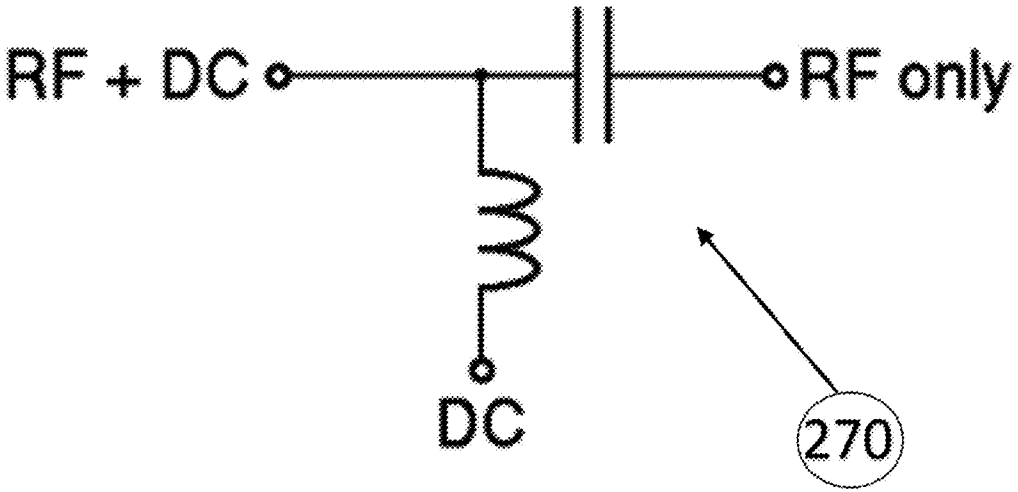
FIG. 27 is a bias tee diplexer schematic.

A bias tee diplexer schematic 270 is shown in FIG. 27.

Figure 28:
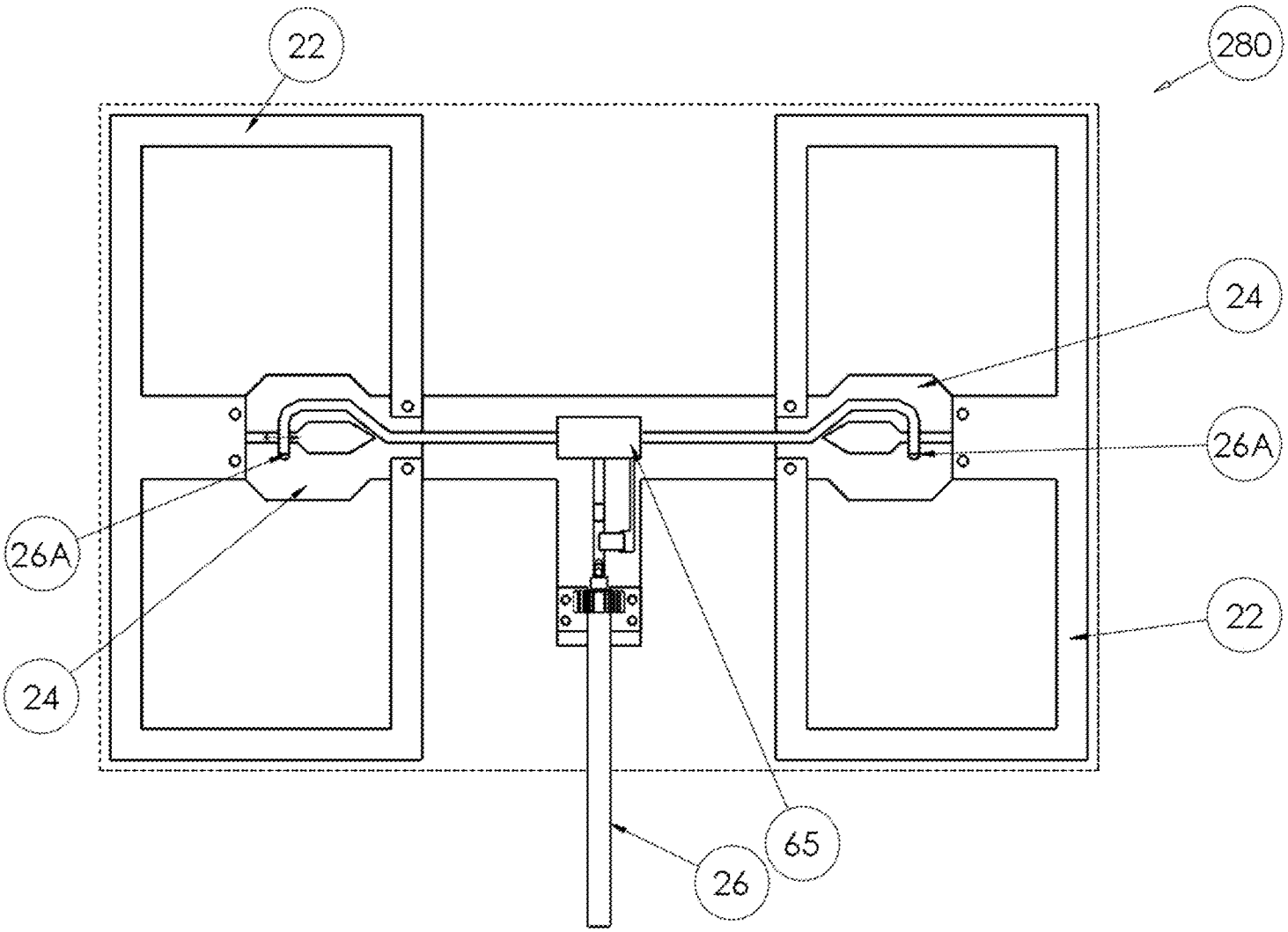
FIG. 28 is an illustration of switchable balanced antenna mirrored pair with a RF switch and a control line diplexed on a coaxial cable.

FIG. 28 is an illustration of switchable balanced antenna mirrored pair 280 with a RF switch and a control line diplexed on a coaxial cable 26.

The RF switch status is controlled by the radio transceiver, which dynamically selects the antenna to use based on some algorithm designed to optimize some parameter of the radio link, for instance RSSI, data transmission speed, level of the interferers received, beamforming with a different antenna and so on. The switch can be connected to the radio transceiver by means of one or more separated control wires, which can also provide the power supply to the switch.

In a preferred arrangement, the switch is designed so that it can be controlled using a single ON/OFF signal, and the (low frequency) control signal is superimposed to the RF signal along the transmission line using the well know bias-tee diplexer.

This arrangement is convenient because no additional control wire is required and therefore the integration of the antenna in the host device is simplified and cost reduced.

Figure 29:
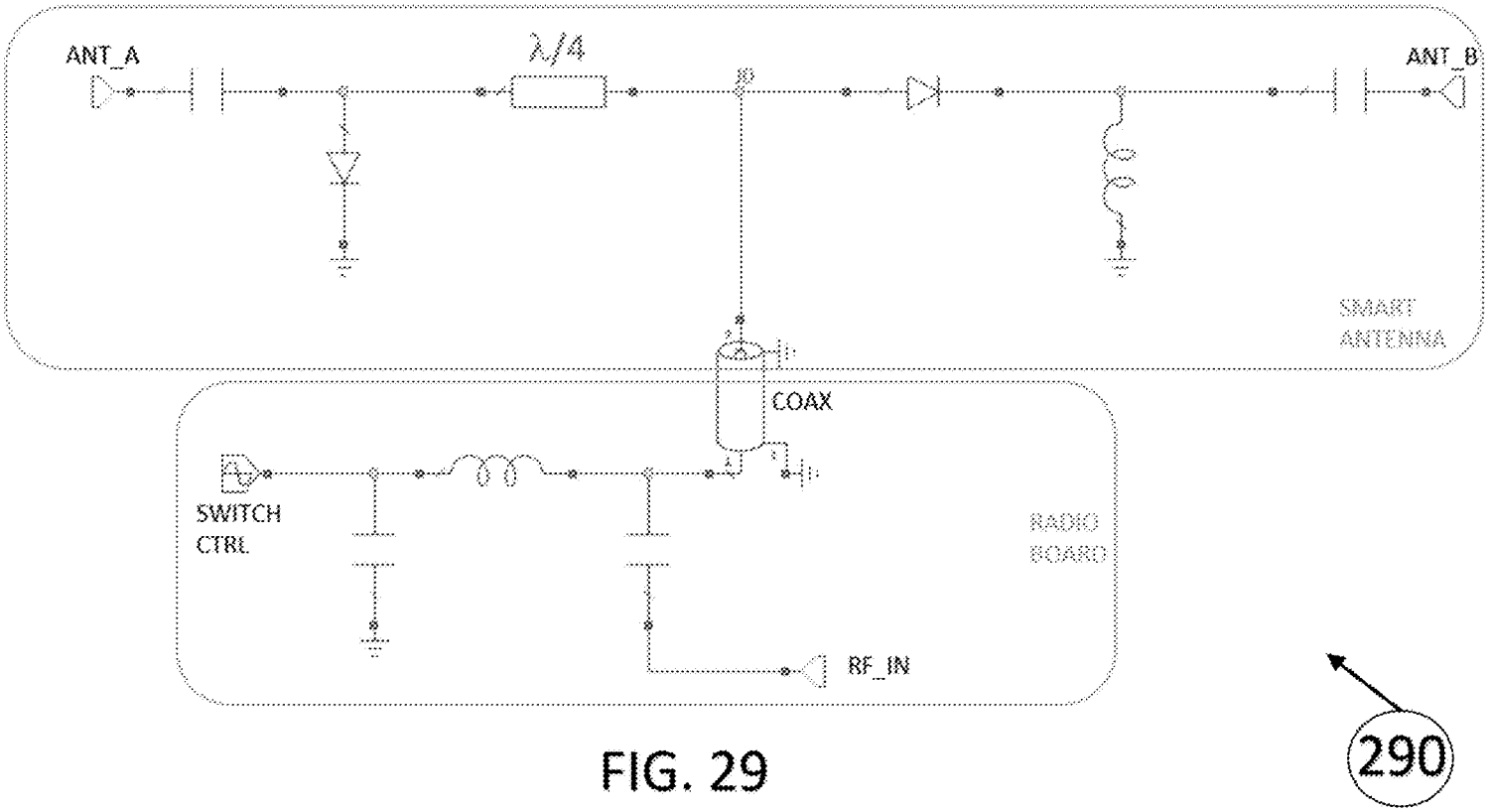
FIG. 29 is a circuit diagram of a switchable balanced antenna pair with a PIN diodes RF switch and a control line diplexed on a coaxial cable.

A detailed example of RF switch that can be controlled using a single ON/OFF signal multiplexed on the RF feeding transmission line is provided in the schematic 290 of FIG. 29. The switch is implemented using two PIN diodes, one in series configuration and the second one in shunt configuration; the ¼ wavelength transmission line between the two diodes is required to ensure that in the ON state (bias applied, both diodes conducting) the RF signal is not shorted to ground at the JO node and the RF signal can flow unimpeded through the diode in series towards Antenna B.

Figure 30:
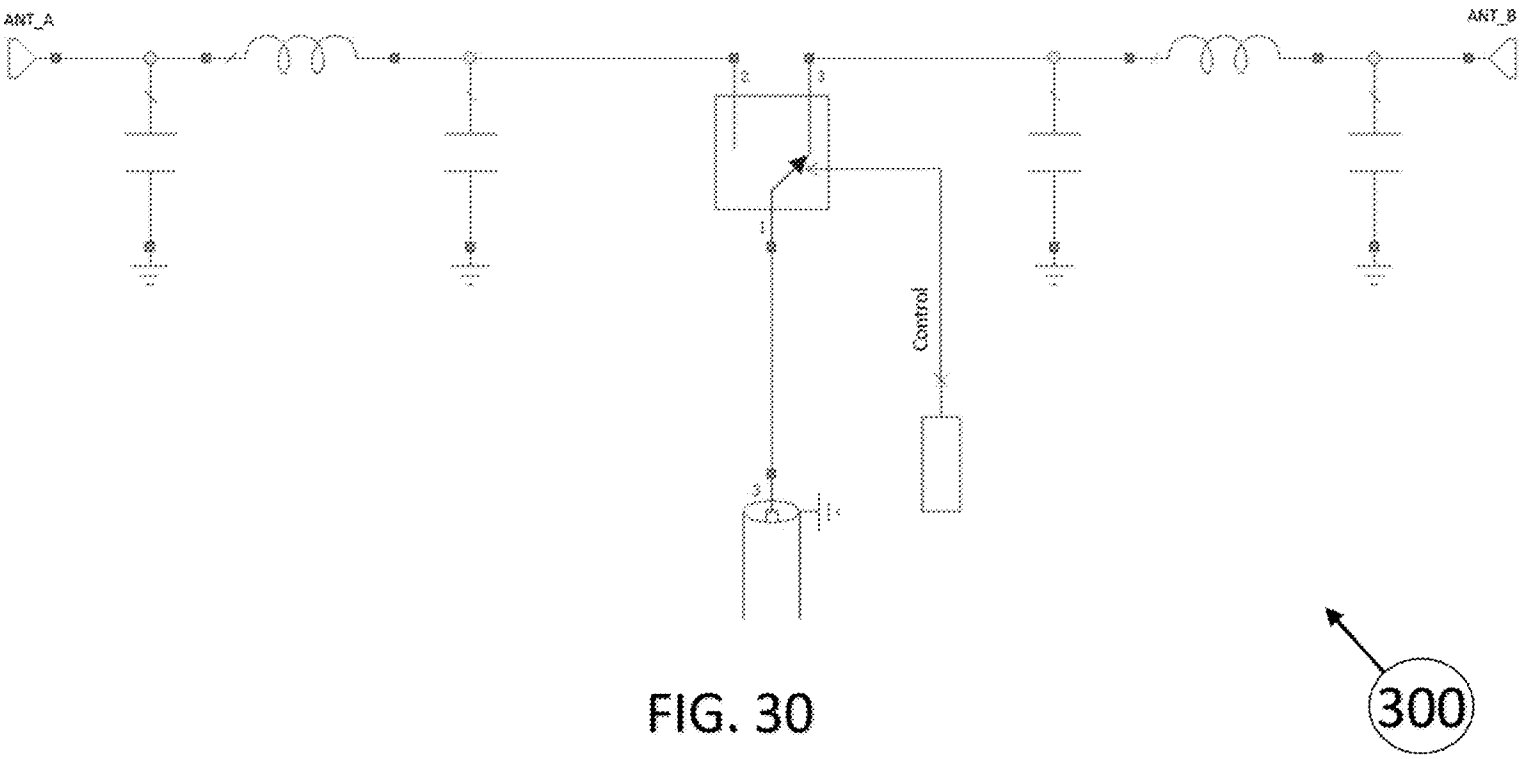
FIG. 30 is circuit diagram for a switchable balanced antenna pair with an RF switch and separate control line and delay lines implemented as P-networks of lumped components.

In a further improvement of the invention, a phase delay is inserted between the switch ports and one or both antennas, with the purpose of altering the phase relation between the two antennas and therefore altering the combined radiation pattern. This might be necessary when the two antennas are arranged very close together and therefore the coupling between the antennas is high; when the RF switch is in a state so that, for instance, antenna A is selected, part of the signal transmitted from antenna A is coupled to antenna B and reaches the unselected port of the switch; unless the RF switch is designed so that it is absorptive, the unselected port of the switch has typically either an impedance similar to a short circuit (very low) or an open circuit (very high), and therefore the signal is reflected back to the antenna and re-radiated; the signal re-radiated by antenna B interferes with that radiated by antenna A altering the overall radiation pattern. The delay line(s) can be used to alter the phase relations between the primary and secondary radiation and generate a more desirable radiation pattern. Said delay line can be realized by means of a given length of transmission line, e.g. a microstrip; alternatively, the delay line can be realized using its well-known lumped components approximation, for instance in T or P configuration. An illustration of this arrangement is given in the schematic 300 of FIG. 30.

Figure 31:
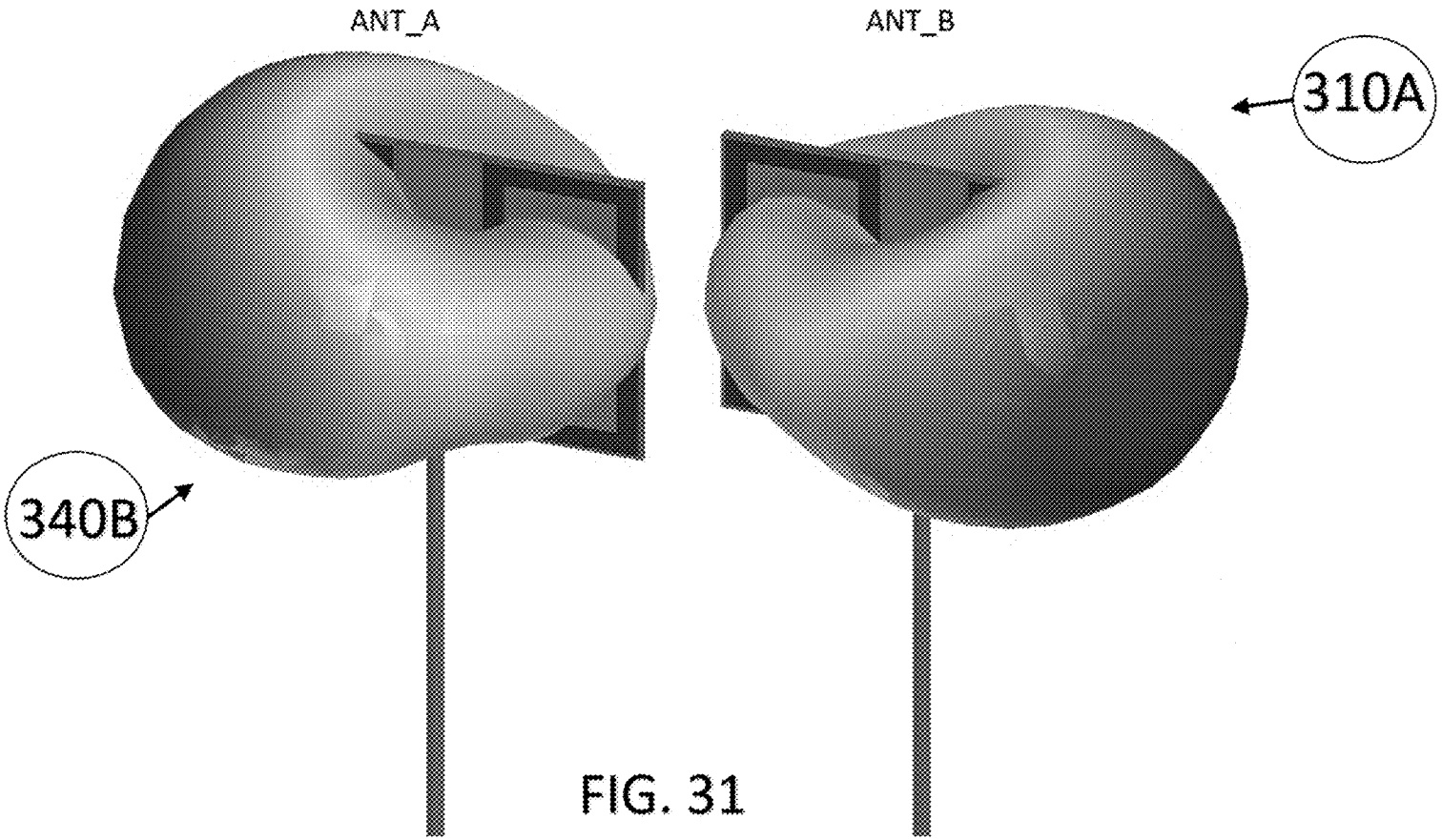
FIG. 31 is an illustration of gain radiation patterns for a balanced antenna mirrored pair in the two states.

In FIG. 31 is given an example of the gain radiation pattern that can be generated by the two antennas, showing that mirrored patterns with the broadside radiation 310*a* and 310*b* in opposite directions can be achieved, which is advantageous in many diversity or smart antenna applications. In general, the polarization vector of the two antennas in this arrangement is the same.

Figure 32:
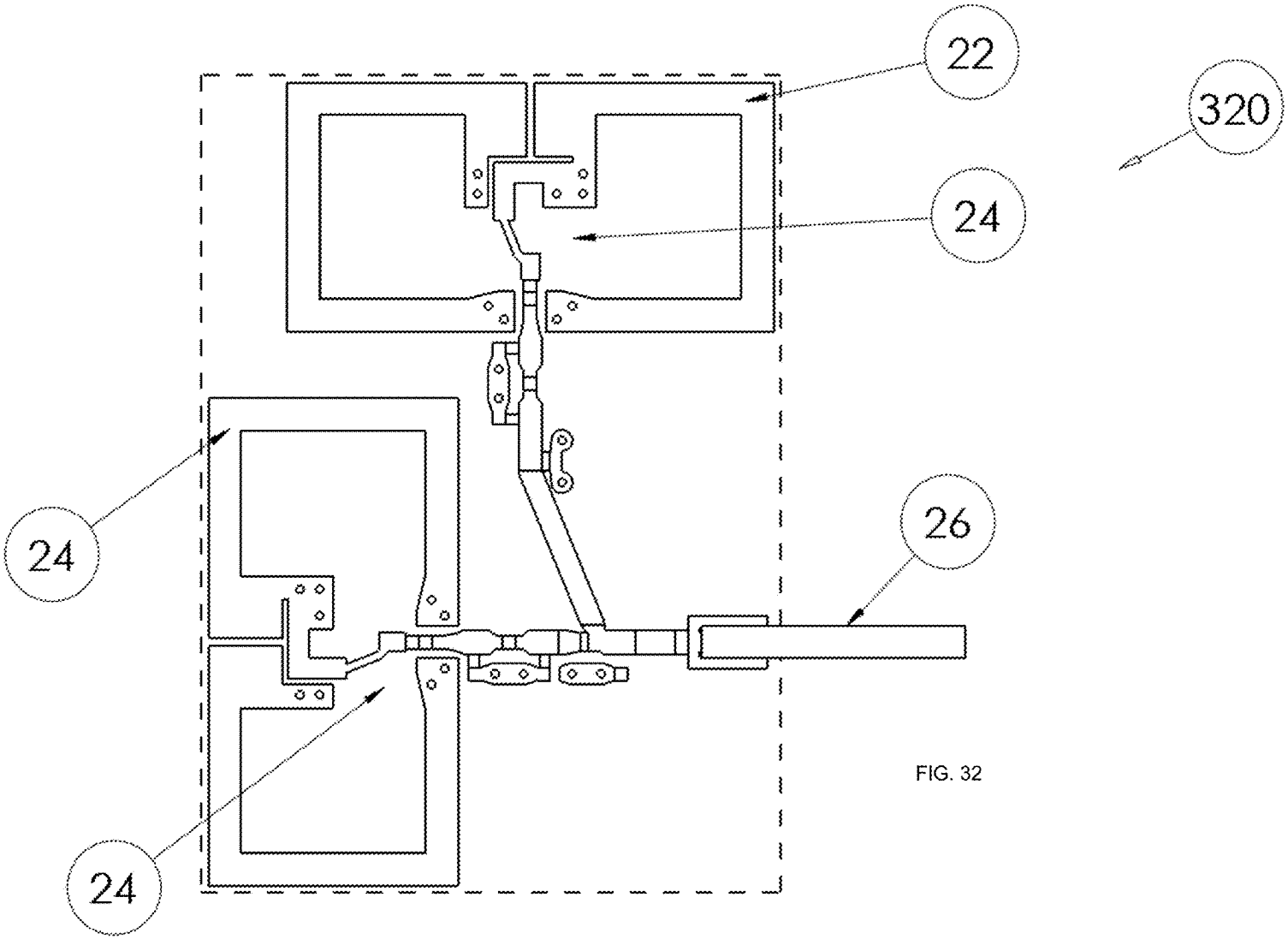
FIG. 32 is an illustration of a switchable balanced antenna pair rotated 90 degrees for polarization diversity.
Figure 33:
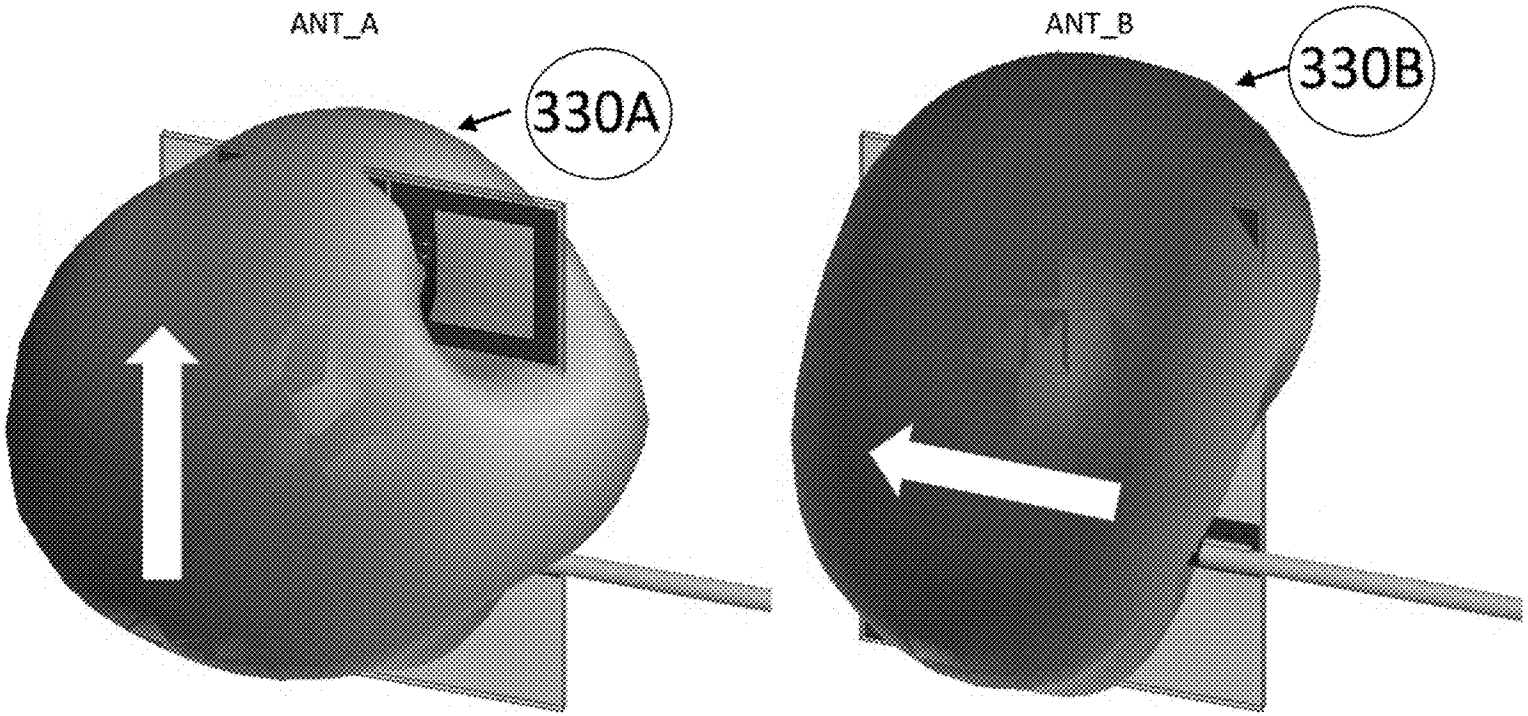
FIG. 33 is an illustration of gain radiation patterns for a balanced antenna rotated pair in the two states, with the arrow indicating the polarization direction.

In a second example of multiple balanced antenna arrangement, illustrated in FIG. 32, the two antennas A and B are arranged in the same plane but rotated 90 degrees one respect to the other. In this case the radiation patterns generated by the two antennas have different polarization, which can be advantageous in some applications, e.g. polarization diversity. The radiation patterns 330*a* and 330*b* relative polarization vectors are illustrated in FIG. 33.

Figure 34:
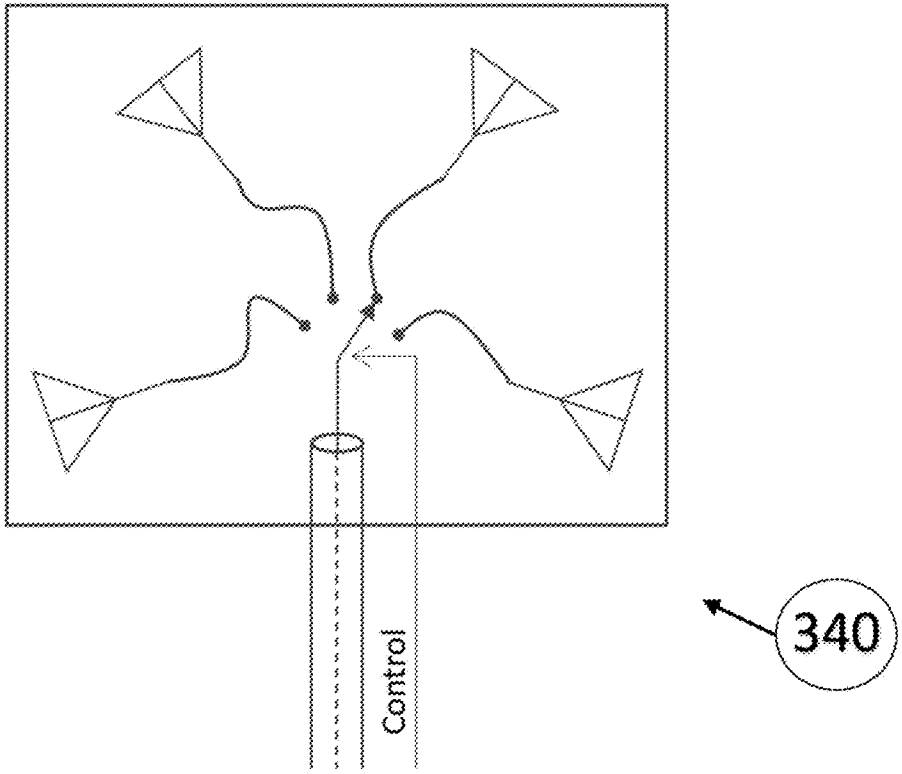
FIG. 34 is an illustration of a multiple antenna arrangement wherein each antenna is a balanced antenna.

The concept is expanded by arranging the two antennas at different angles, or more than two antennas on the same assembly 340, as schematically illustrated in FIG. 34. An RF switch with a number of ports matching the number of antennas has to be used in that case.

He, U.S. Pat. No. 9,362,621 for a Multi-Band LTE Antenna is hereby incorporated by reference in its entirety.

Abramov et al., U.S. Pat. No. 7,215,296 for a Switch Multi-Beam Antenna Serial is hereby incorporated by reference in its entirety.

Salo et al., U.S. Pat. No. 7,907,971 for an Optimized Directional Antenna System is hereby incorporated by reference in its entirety.

Abramov et al., U.S. Pat. No. 7,570,215 for an Antenna device with a controlled directional pattern and a planar directional antenna is hereby incorporated by reference in its entirety.

Abramov et al., U.S. Pat. No. 7,570,215 for an Antenna device with a controlled directional pattern and a planar directional antenna is hereby incorporated by reference in its entirety.

Abramov et al., U.S. Pat. No. 8,423,084 for a Method for radio communication in a wireless local area network and transceiving device is hereby incorporated by reference in its entirety.

Khitrik et al., U.S. Pat. No. 7,336,959 for an Information transmission method for a wireless local network is hereby incorporated by reference in its entirety.

Khitrik et al., U.S. Pat. No. 7,043,252 for an Information transmission method for a wireless local network is hereby incorporated by reference in its entirety.

Abramov et al., U.S. Pat. No. 8,184,601 for a METHOD FOR RADIO COMMUNICATION INA WIRELESS LOCAL AREA NETWORK WIRELESS LOCAL AREA NETWORK AND TRANSCEIVING DEVICE is hereby incorporated by reference in its entirety.

Abramov et al., U.S. Pat. No. 7,627,300 for a Dynamically optimized smart antenna system is hereby incorporated by reference in its entirety.

Abramov et al., U.S. Pat. No. 6,486,832 for a Direction-agile antenna system for wireless communications is hereby incorporated by reference in its entirety.

Yang, U.S. Pat. No. 8,081,123 for a COMPACT MULTI-LEVEL ANTENNA WITH PHASE SHIFT is hereby incorporated by reference in its entirety.

Nagaev et al., U.S. Pat. No. 7,292,201 for a Directional antenna system with multi-use elements is hereby incorporated by reference in its entirety.

Abramov et al., U.S. Pat. No. 7,696,948 for a Configurable directional antenna is hereby incorporated by reference in its entirety.

Abramov et al., U.S. Pat. No. 7,965,242 for a Dual-band antenna is hereby incorporated by reference in its entirety.

Abramov et al., U.S. Pat. No. 7,729,662 for a Radio communication method in a wireless local network is hereby incorporated by reference in its entirety.

Abramov et al., U.S. Pat. No. 8,248,970 for an OPTIMIZED DIRECTIONAL MIMO ANTENNA SYSTEM is hereby incorporated by reference in its entirety.

Visuri et al., U.S. Pat. No. 8,175,036 for a MULTIMEDIA WIRELESS DISTRIBUTION SYSTEMS AND METHODS is hereby incorporated by reference in its entirety.

Yang, U.S. Patent Publication Number 20110235755 for an MIMO Radio System With Antenna Signal Combiner is hereby incorporated by reference in its entirety.

Yang et al., U.S. Pat. No. 9,013,355 for an L SHAPED FEED AS PART OF A MATCHING NETWORK FOR A MICROSTRIP ANTENNA is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

I claim as my invention the following:

1. A balanced antenna system comprising:

a cable;

an antenna comprising a first planar conductor layer forming an first infinite balun, a second planar conductor layer forming a second infinite balun, and a feeding gap; and wherein the cable transports a radio signal from the antenna to a radio and from a radio to the antenna;

wherein the first infinite balun and the second infinite balun transform an unbalanced transmission line characteristic of the cable to the balanced feeding of the antenna.

2. The balanced antenna system according to claim 1 wherein the cable is offset from a symmetry axis of the antenna, and positioned to feed the antenna across the feeding gap.

3. The balanced antenna system according to claim 2 wherein the cable exits from the antenna along the symmetry axis.

4. The balanced antenna system according to claim 1 wherein an electromagnetic current excited at the feeding gap of the antenna cannot flow along an outer shielding of the coaxial cable.

5. The balanced antenna system according to claim 1 wherein the first planar conducting layer has a first section, a second section perpendicular to and extending outward from the first section, a third section perpendicular to the second section and a parallel to the first section, a fourth section perpendicular to and extending inward from the third section, a fifth section perpendicular to and extending outward from the first section, a sixth section perpendicular to the fifth section and a parallel to the first section, and a seventh section perpendicular to and extending inward from the sixth section.

6. The balanced antenna system according to claim 1 further comprising a non-conductive support structure.

7. The balanced antenna system according to claim 1 wherein the first infinite balun and the second infinite balun are positioned on the same plane.

8. The balanced antenna system according to claim 1 further comprising an interdigital capacitor between two arms of the first infinite balun or the second infinite balun.

9. The balanced antenna system according to claim 1 further comprising a waveguide at the feeding gap.

10. The balanced antenna system according to claim 1 further comprising a dielectric layer separating the first infinite balun and the second infinite balun, the first infinite balun and the second infinite balun are electrically connected using a plurality of plated via holes.

11. The balanced antenna system according to claim 7 wherein the 1 cable is on a layer different than the first infinite balun and the second infinite balun, and further comprising a microstrip line connected to the cable.

12. The balanced antenna system according to claim 7 wherein the cable is on the same layer as the first infinite balun and the second infinite balun, and further comprising a microstrip line on a different layer and connected to the cable using a via plated hole.

13. A balanced antenna system comprising:

a transmission line;

an antenna comprising a first planar conductor layer forming an first infinite balun, a second planar conductor layer forming a second infinite balun, and a feeding gap; and at least one conducting element positioned between the plurality of planar conductor layers;

wherein the first infinite balun and the second infinite balun have a mirror symmetry with respect to an axis lying in a plane defined by conductor layers;

wherein the planar projection of the second infinite balun is contained within the planar projection of the first infinite balun;

wherein the first infinite balun and the second infinite balun transform an unbalanced transmission line characteristic of the transmission line to the balanced feeding of the antenna.

14. The balanced antenna system according to claim 13 wherein an end part of the transmission line runs along one side of the second infinite balun and is electrically connected to the second infinite balun and a conducting core of the transmission line is electrically connected to the other side of the second infinite balun.

15. The balanced antenna system according to claim 13 wherein the first infinite balun and the second infinite balun are electrically connected.

16. The balanced antenna system according to claim 13 wherein an electromagnetic current excited at the feeding gap of the antenna cannot flow along an outer shielding of the transmission line.

17. The balanced antenna system according to claim 13 wherein the first planar conducting layer has a first section, a second section perpendicular to and extending outward from the first section, a third section perpendicular to the second section and a parallel to the first section, a fourth section perpendicular to and extending inward from the third section, a fifth section perpendicular to and extending outward from the first section, a sixth section perpendicular to the fifth section and a parallel to the first section, and a seventh section perpendicular to and extending inward from the sixth section.

18. The balanced antenna system according to claim 13 further comprising an interdigital capacitor between two arms of the first infinite balun or the second infinite balun.

19. The balanced antenna system according to claim 13 further comprising a waveguide at the feeding gap.

20. The balanced antenna system according to claim 13 further comprising a dielectric layer separating the first infinite balun and the second infinite balun, the first infinite balun and the second infinite balun are electrically connected using a plurality of plated via holes.

* * * * *